US012709509B2

(12) United States Patent
Akamatsu

(10) Patent No.: US 12,709,509 B2
(45) Date of Patent: Aug. 18, 2026

(54) SHEET STACKING APPARATUS AND IMAGE FORMING APPARATUS

(71) Applicant: CANON KABUSHIKI KAISHA, Tokyo (JP)

(72) Inventor: Yuki Akamatsu, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/640,272

(22) Filed: Apr. 19, 2024

(65) Prior Publication Data

US 2024/0367934 A1 Nov. 7, 2024

(30) Foreign Application Priority Data

May 1, 2023 (JP) ..... 2023-075837

(51) Int. Cl.

| | |
|---|---|
| ***B65H 29/36*** | (2006.01) |
| ***B65H 7/02*** | (2006.01) |
| ***B65H 29/04*** | (2006.01) |
| ***B65H 43/02*** | (2006.01) |

(52) U.S. Cl.

CPC ..... *B65H 29/041* (2013.01); *B65H 7/02* (2013.01); *B65H 43/02* (2013.01); *B65H 2301/44712* (2013.01)

(58) Field of Classification Search

CPC ..... B65H 29/041; B65H 7/02; B65H 43/02; B65H 2301/44712; B65H 29/36; B65H 29/18; B65H 29/16; B65H 29/005

See application file for complete search history.

(56) References Cited

U.S. PATENT DOCUMENTS

| | | | | |
|---|---|---|---|---|
| 6,341,698 | B1 * | 1/2002 | Wursthorn | B65H 29/36 209/552 |
| 8,152,162 | B2 | 4/2012 | Obuchi | |
| 2010/0129189 | A1 * | 5/2010 | Ward | B26D 7/32 83/13 |

FOREIGN PATENT DOCUMENTS

| | | | |
|---|---|---|---|
| JP | 61-90962 | * | 5/1986 |
| JP | 2010168218 | A | 8/2010 |

OTHER PUBLICATIONS

Machine translation of JP61-90962. (Year: 1986).*

* cited by examiner

*Primary Examiner* — Thomas A Morrison
(74) *Attorney, Agent, or Firm* — ROSSI, KIMMS & McDOWELL LLP

(57) ABSTRACT

A sheet stacking apparatus includes a stacking portion, a conveyance member, an abutment portion, a belt member, a nipping portion configured to nip the belt member, a lifting/lowering unit configured to lift and lower the nipping portion, and a controller configured to control the lifting/lowering unit such that, in a case where the belt member moves a current sheet and then moves a next sheet, (i) the nipping portion is positioned at the first position after the belt member contacts the current sheet and before the leading edge of the current sheet abuts against the abutment portion, and (ii) the nipping portion is positioned at the second position after the leading edge of the current sheet abuts against the abutment portion and before the belt member contacts the next sheet.

19 Claims, 8 Drawing Sheets

SHEET STACKING APPARATUS AND IMAGE FORMING APPARATUS

BACKGROUND OF THE INVENTION

Field of the Invention

The present invention relates to a sheet stacking apparatus for stacking sheets, and an image forming apparatus for forming images on sheets.

Description of the Related Art

In an image forming apparatus, a sheet stacking apparatus, such as a large-capacity stacker, is used for stacking sheets on which images are formed. Japanese Patent Application Publication No. 2010-168218 describes a sheet stacking apparatus. The sheet stacking apparatus conveys a sheet while causing a gripper supported by a timing belt, to hold the sheet; and then causes a knurled belt to abut the leading edge of the sheet against a stopper for aligning the sheet.

However, in the configuration described in Japanese Patent Application Publication No. 2010-168218, there is a case in which the sheet moves in the sheet width direction after the leading edge of the sheet is abutted against the stopper. In this case, the alignment of the sheet deteriorates.

SUMMARY OF THE INVENTION

The present invention can provide a sheet stacking apparatus and an image forming apparatus that can improve alignment of sheets.

According to an aspect of the invention, a sheet stacking apparatus includes a stacking portion on which a sheet is stacked, a conveyance member configured to convey the sheet toward the stacking portion, an abutment portion against which a leading edge of the sheet in a sheet conveyance direction is abutted, a belt member having elasticity and configured to move the sheet conveyed to the stacking portion, toward the abutment portion in the sheet conveyance direction, a nipping portion configured to nip the belt member, a lifting/lowering unit configured to lift and lower the nipping portion between a first position and a second position, the first position being a position for causing the belt member to contact the sheet stacked on the stacking portion, the second position being a position above the first position, and a controller configured to control the lifting/lowering unit such that, in a case where the belt member moves a current sheet and then moves a next sheet to be stacked on the stacking portion after the current sheet is stacked, (i) the nipping portion is positioned at the first position after the belt member contacts the current sheet and before the leading edge of the current sheet abuts against the abutment portion, and (ii) the nipping portion is positioned at the second position after the leading edge of the current sheet abuts against the abutment portion and before the belt member contacts the next sheet.

Further features of the present invention will become apparent from the following description of exemplary embodiments with reference to the attached drawings.

DESCRIPTION OF THE EMBODIMENTS

Hereinafter, an embodiment of the present disclosure will be described with reference to the accompanying drawings.

First Embodiment

Figure 1:
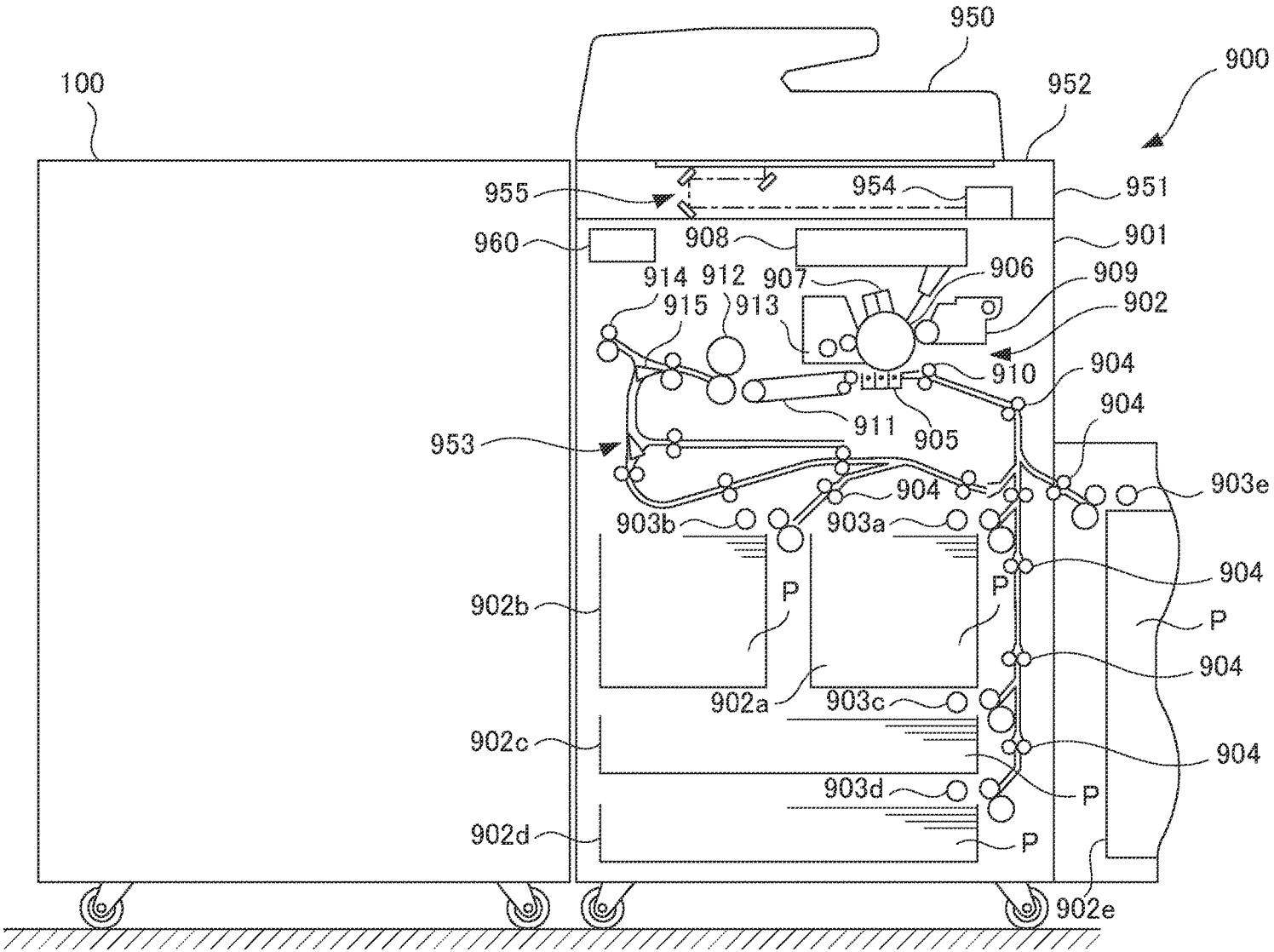
FIG. 1 is a schematic diagram of an image forming apparatus of a first embodiment.

FIG. 1 is a schematic diagram of an image forming apparatus 900 of an embodiment. The image forming apparatus 900 includes an image forming apparatus body (printer portion) 901 and a stacker 100. The image forming apparatus body 901 forms an image on a sheet P. The stacker 100 serves as a sheet stacking apparatus that receives the sheet P, on which an image is formed, from the image forming apparatus body 901, and stacks the sheet P. The sheet P, which is a recording material (recording medium), may be any one of a variety of sheets with different sizes and materials. For example, the sheet P may be a paper sheet, such as a plain paper sheet or a thick paper sheet, a sheet material, such as a coated paper sheet, on which certain surface treatment has been performed, a specially-shaped sheet material, such as an envelope or an index paper sheet, a plastic film, or a cloth sheet.

The image forming apparatus 900 is an image forming system that includes the image forming apparatus body 901 and the stacker 100. Note that the image forming apparatus 900 may include another apparatus other than the image forming apparatus body 901 and the stacker 100. Examples of such an apparatus include a sheet feeding apparatus (option feeder) that feeds a sheet P to the image forming apparatus body 901, and a sheet processing apparatus (finisher) that performs a process, such as a binding process, on the sheet P.

The image forming apparatus body 901 includes an image forming portion 902, a fixing apparatus 912, a duplex conveyance portion 953, an image reading apparatus 951, and a control portion 960. The image forming portion 902 includes a photosensitive drum 906 that serves as an image bearing member, a charging apparatus 907, an exposure apparatus 908, a developing apparatus 909, a transfer apparatus 905, and a cleaning apparatus 913. The fixing apparatus 912 is a heat-fixing apparatus that includes a heating roller, a pressing roller, and a heat source, such as a halogen lamp, that heats the heating roller.

The image reading apparatus 951 includes a scanner unit 955 and an image sensor 954. On the top surface of the image forming apparatus body 901, a platen glass 952 on which a document is placed is disposed. In addition, above the image forming apparatus body 901, a document feeding apparatus 950 that automatically feeds a document is disposed.

The image forming apparatus body 901 also includes cassettes 902*a* to 902*d* that serve as sheet storing portions, feeding rollers 903*a* to 903*d* that serve as feeding members, and a registration roller 910. In addition, the image forming apparatus body 901 includes a plurality of conveyance roller pairs 904 that are disposed along a sheet conveyance path, and a discharging roller pair 914 that serves as a discharging member. Furthermore, a sheet feeding apparatus connected with the image forming apparatus body 901 includes a cassette 902*e*, and a feeding roller 903*e* that feeds a sheet P toward the image forming apparatus body 901.

Next, an image forming operation of the image forming apparatus body 901 will be described. If an image forming signal is outputted from the control portion 960, a document is fed by the document feeding apparatus 950. The image reading apparatus 951 causes the scanner unit 955 to optically scan the document that is being conveyed, and causes the image sensor 954 to convert an optical image to image data (digital data). Note that the image reading apparatus 951 can read the image data of a stationary document (that is not moved) placed on the platen glass 952, by moving the scanner unit 955. The image data that has been read by the image reading apparatus 951 is sent to the exposure apparatus 908.

In the image forming portion 902, the photosensitive drum 906 is driven and rotated, and the surface of the photosensitive drum 906 is uniformly charged by the charging apparatus 907. The exposure apparatus 908 emits a laser beam to the photosensitive drum 906 in accordance with the image data, and exposes the photosensitive drum 906 with the laser beam. With this operation, an electrostatic latent image is formed on the surface of the photosensitive drum 906. The developing apparatus 909 supplies toner, which serves as developer, to the photosensitive drum 906; and develops the electrostatic latent image into a toner image. The toner image is bome by the photosensitive drum 906, and is conveyed toward a transfer portion in which the photosensitive drum 906 and the transfer apparatus 905 face each other.

In parallel with the formation of the toner image by the image forming portion 902, a sheet conveyance operation is performed. If a feeding signal is outputted from the control portion 960, the sheet P is fed, one by one, from any one of the cassettes 902*a* to 902*e* by a corresponding one of the feeding rollers 903*a* to 903*e*. The sheet P is fed to the registration roller 910, and the skew of the sheet P is corrected by the registration roller 910. After that, the sheet P is conveyed to the transfer portion at a timing that is synchronized with the formation of the toner image by the image forming portion 902. In the transfer portion, the toner image is transferred from the photosensitive drum 906 to the sheet P by an electric-field bias produced by the transfer apparatus 905. The cleaning apparatus 913 removes sticking substance, such as transfer residual toner that has not been transferred from the photosensitive drum 906 to the sheet P, from the surface of the photosensitive drum 906 for the next image formation. The sheet P having passed through the transfer portion is conveyed to the fixing apparatus 912 by a conveyance belt 911. The fixing apparatus 912 fixes the toner image to the sheet P by heating and pressing the toner image formed on the sheet P, while nipping and conveying the sheet P.

The sheet Shaving passed through the fixing apparatus 912 is guided to the discharging roller pair 914 or the duplex conveyance portion 953, by a switching member 915. If a single-side image forming operation (i.e., single-side printing) is performed for forming an image on a single side of the sheet P, the sheet P is guided to the discharging roller pair 914, and is discharged from the image forming apparatus body 901 by the discharging roller pair 914. If a double-side image forming operation (i.e., double-side printing) is performed for forming images on both sides of the sheet P, the sheet P on which an image is formed on a first side of the sheet P is guided to the duplex conveyance portion 953. The duplex conveyance portion 953 reverses (switch-backs) the sheet P such that the first side and the second side of the sheet P are turned upside down, and conveys the sheet P to the registration roller 910 again. Then the sheet P passes through the transfer portion and the fixing apparatus 912, so that an image is formed on the second side of the sheet P After that, the sheet P is discharged from the image forming apparatus body 901 by the discharging roller pair 914.

Note that although the description has been made for the image forming operation based on the image data that is read from a document by the image reading apparatus 951, the image forming apparatus 900 may perform an image forming operation, based on the image data that the image forming apparatus 900 receives from an external computer, for example. In addition, the above-described image forming portion 902 that is a direct-transfer electrophotographic unit is one example of an image forming portion that forms an image on the sheet P For example, the image forming portion may be an intermediate-transfer electrophotographic unit that transfers a toner image from the image bearing member to a sheet via an intermediate transfer member, an ink-jet printing unit, or an offset-printing unit.

Control Portion

Figure 2:
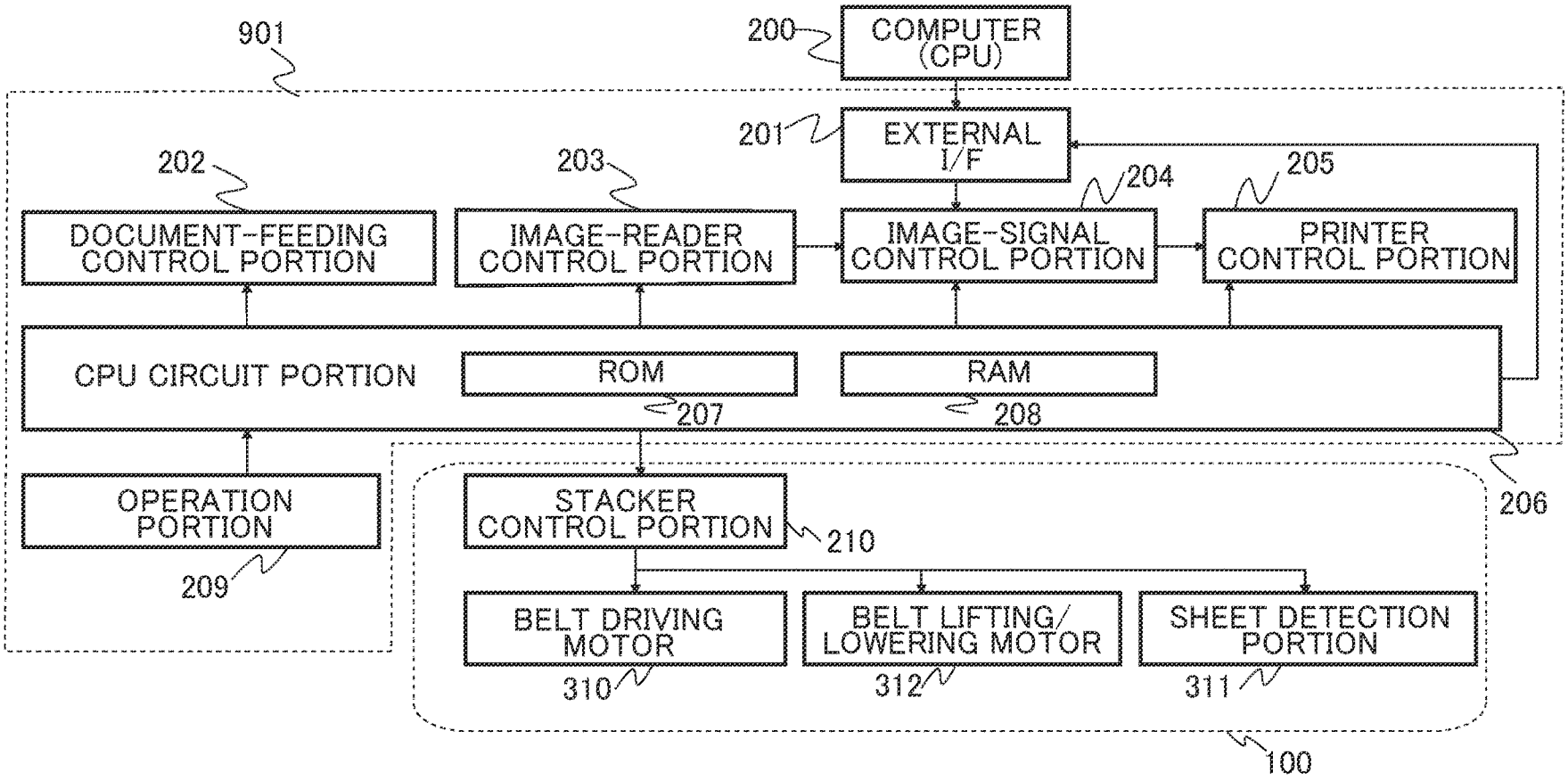
FIG. 2 is a block diagram of the image forming apparatus of the first embodiment.

FIG. 2 is a block diagram illustrating a configuration of the control portion 960 of the image forming apparatus body 901. The control portion 960 includes a CPU circuit portion 206, an external I/F 201, a document-feeding control portion 202, an operation portion 209, an image-reader control portion 203, an image-signal control portion 204, and a printer control portion 205. The CPU circuit portion 206 includes a CPU, a ROM 207, and a RAM 208. The CPU controls the whole of the document-feeding control portion 202, the operation portion 209, the image-reader control portion 203, the image-signal control portion 204, the printer control portion 205, and a stacker control portion 210 by reading a control program stored in the ROM 207, and executing the program.

The RAM 208 temporarily stores control data, and is used as a work area for a computation process for the control. The document-feeding control portion 202 drives and controls the document feeding apparatus 950, depending on an instruction from the CPU circuit portion 206. The image-reader control portion 203 drives and controls the scanner unit 955 and the image sensor 954 of the image reading apparatus 951, and transfers an analog image signal outputted from the image sensor 954, to the image-signal control portion 204. The image-signal control portion 204 converts the analog image signal sent from the image sensor 954, to a digital image signal; then performs various processes on the digital image signal; then converts the processed digital image signal to a video signal; and then outputs the video signal to the printer control portion 205.

The external I/F 201 is an interface between the image forming apparatus 900 and an external computer 200. The external I/F 201 receives image data from the computer 200, develops the image data into a bitmap image, and outputs the bitmap image to the image-signal control portion 204, as a digital image signal. The image-signal control portion 204 receives the digital image signal from the external I/F 201, performs various processes on the digital image signal, converts the processed digital image signal to a video signal, and outputs the video signal to the printer control portion 205. The processing operation by the image-signal control portion 204 is controlled by the CPU circuit portion 206.

The printer control portion 205 drives the exposure apparatus 908 via an exposure control portion, depending on the inputted video signal. The operation portion 209 includes an input apparatus (such as a touch panel or buttons) and a display apparatus (such as a liquid crystal panel). The input apparatus accepts an operation for changing the setting (i.e., job setting) of various functions for forming images. The display apparatus displays information, such as current job setting, for a user. The operation portion 209 displays the information on the display apparatus, depending on an instruction from the CPU circuit portion 206; and outputs a signal to the CPU circuit portion 206 in accordance with an operation of a user to the input apparatus. A user can set sheet attribute information of the sheet P (hereinafter referred to as sheet information) used for the image forming operation, by operating the operation portion 209. Examples of the sheet information include the information on the size of the sheet P, the information on the grammage of the sheet P, and the information on the material of the sheet P (for distinguishing the coated paper sheet, the plain paper sheet, and the recycled paper sheet from each other).

The stacker control portion 210 is mounted on the stacker 100. The stacker control portion 210 exchanges the information with the CPU circuit portion 206 of the image forming apparatus body 901, and thereby controls the whole of the stacker 100 that includes a belt driving motor 310, which drives a below-described drawing belt 16, a belt lifting/lowering motor 312, and a sheet detection portion 311. The control of the stacker 100 will be described below.

Note that the stacker control portion 210 is one example of a controller that controls the operation of the stacker 100. The control function of the stacker control portion 210 of the present embodiment may be performed by another controller outside the stacker 100. For example, the above-described control function may be embedded in the CPU circuit portion 206 of the image forming apparatus body 901, and the CPU circuit portion 206 may control the belt driving motor 310 of the stacker 100, from the image forming apparatus body 901.

Stacker

Figure 3:
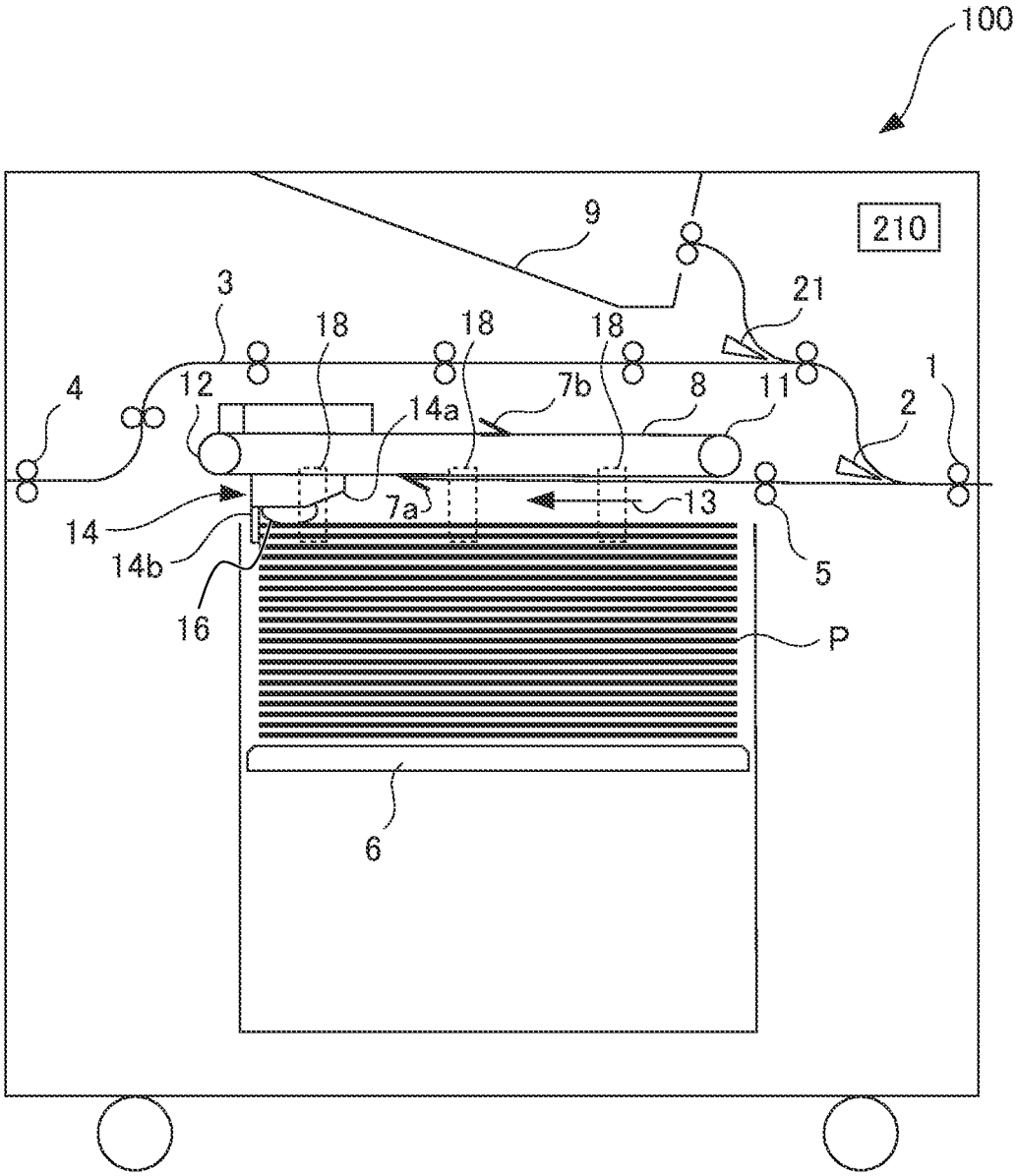
FIG. 3 is a schematic diagram of a stacker of the first embodiment.
Figure 4A:
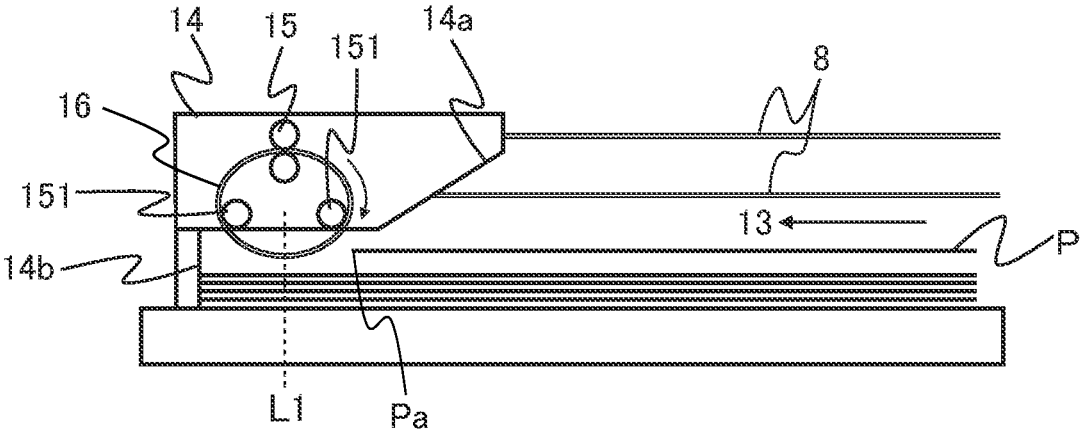
FIG. 4A is an enlarged view in which one portion of the stacker of the first embodiment is enlarged.

Next, the stacker 100 that is a sheet stacking apparatus of the present embodiment will be described with reference to FIGS. 3 and 4A. FIG. 3 is a schematic diagram illustrating a configuration of the stacker 100. FIG. 4A is an enlarged view in which one portion (i.e., the drawing belt 16 and its surroundings) of the stacker 100 is enlarged.

The stacker 100 includes an inlet roller pair 1, a first switching member 2, a second switching member 21, a conveyance path 3, an outlet roller pair 4, and a sample tray 9. In addition, the stacker 100 includes a discharging roller pair 5, a stacking tray 6, grippers 7*a* and 7*b*, a gripper belt 8, a leading-edge stopper 14, the drawing belt 16, and a side-edge regulation member 18. The leading-edge stopper 14 includes an abutment slope 14*a* and a leading-edge abutment surface 14*b*.

The stacking tray 6 is an example of a stacking portion on which the sheet P is stacked. The discharging roller pair 5 is an example of a conveyance member that conveys the sheet P toward the stacking portion. The leading-edge abutment surface 14*b* of the leading-edge stopper 14 is an example of an abutment portion against which the leading edge of the sheet P in a sheet conveyance direction 13 (i.e., the downstream edge of the sheet P in the sheet conveyance direction 13) is abutted. The drawing belt 16 is an example of a belt member that moves the sheet P toward the abutment portion in the sheet conveyance direction 13.

The inlet roller pair 1 receives the sheet P discharged from the image forming apparatus body 901, and conveys the sheet P The first switching member 2 switches the conveyance path of the sheet P sent from the inlet roller pair 1, between a conveyance path that extends toward the outlet roller pair 4 or the sample tray 9 and a conveyance path (stacking path) that extends toward the stacking tray 6. The second switching member 21 switches the conveyance path of the sheet P between the conveyance path 3 that extends toward the outlet roller pair 4 and a conveyance path that extends toward the sample tray 9. The outlet roller pair 4 discharges the sheet P conveyed through the conveyance path 3, to the outside of the stacker 100.

The discharging roller pair 5 conveys the sheet P in the sheet conveyance direction 13, and discharges the sheet P toward the stacking tray 6. The gripper belt (i.e., a timing belt or a second belt member) 8 is disposed above the stacking tray 6, and is stretched by and wound around a driving pulley 11 and a driven pulley 12. The gripper belt 8 is driven and rotated in a rotational direction along the sheet conveyance direction 13, by the rotation of the driving pulley 11 that is driven by a belt motor. The grippers 7*a* and 7*b* are attached to the gripper belt 8 and disposed at predetermined positions in the circumferential direction of the gripper belt 8, and rotate together with the gripper belt 8. Each of the grippers 7*a* and 7*b* is moved in the sheet conveyance direction 13 in a state where the gripper holds (or nips) the leading edge of the sheet discharged from the discharging roller pair 5.

The stacking tray 6 can move up and down in the stacker 100. The stacking tray 6 is controlled so as to move up and down in accordance with the amount of stacked sheets. For example, the stacking tray 6 is controlled so that the top surface of sheets P stacked on the stacking tray 6 is kept at a substantially predetermined height, on the basis of the detection result of a sheet-top-surface sensor that detects the sheet P at a predetermined height above the stacking tray 6.

The leading-edge stopper 14 is disposed at an end portion of a stacking space above the stacking tray 6. The end portion is located downstream in the sheet conveyance direction 13. The abutment slope 14*a* of the leading-edge stopper 14 projects downward from the bottom surface of the gripper belt 8, and the leading-edge abutment surface 14*b* is disposed below the abutment slope 14*a*.

The abutment slope 14*a* is an example of an abutment surface that abuts against the leading edge of the sheet P held by the gripper 7*a* or 7*b* and thereby separates the sheet P from the gripper 7*a* or 7*b*. The abutment slope 14*a* of the present embodiment is a sloped surface that is sloped downward toward the downstream side in the sheet conveyance direction 13. The leading-edge abutment surface 14*b* is a surface that extends in a substantially vertical direction when viewed in a sheet width direction orthogonal to the sheet conveyance direction 13 (that is, when viewed in FIG. 3). The leading-edge abutment surface 14*b* serves as the reference of alignment of sheets P, stacked on the stacking tray 6, in the sheet conveyance direction 13.

The drawing belt 16 is disposed above the stacking tray 6. In addition, the drawing belt 16 is disposed downstream of the upstream edge of the abutment slope 14*a* and upstream of the leading-edge abutment surface 14*b* in the sheet conveyance direction 13. As illustrated in FIG. 4A, the drawing belt 16 is nipped by a belt-driving-roller pair 15. The belt-driving-roller pair 15 is driven and rotated by the belt driving motor 310 (FIG. 2). By the rotation of the belt-driving-roller pair 15, the drawing belt 16 is driven and rotated in a clockwise direction in FIG. 4A (that is, in a rotational direction in which a lower portion of the drawing belt 16 moves from the upstream side to the downstream side in the sheet conveyance direction 13). Note that the inner circumferential surface of the drawing belt 16 is guided by guide rollers 151 disposed at positions different from the position of the belt-driving-roller pair 15.

The drawing belt 16 is formed endless, and is made of an elastic material such as silicone rubber, ethylene-propylene diene monomer rubber (EPDM), or urethane rubber. The drawing belt 16 is disposed so that the drawing belt 16 elastically deforms when brought into contact with the top surface of sheets P stacked on the stacking tray 6. Due to the elasticity of the drawing belt 16, an appropriate contact pressure is produced when the outer circumferential surface of the drawing belt 16 contacts the top surface of the stack of sheets stacked on the stacking tray 6.

The belt-driving-roller pair 15 is moved (lifted and lowered) in the up-down direction by the belt lifting/lowering motor 312 (FIG. 2) that serves as a lifting/lowering unit. The belt-driving-roller pair 15 that serves as a nipping portion that nips the drawing belt 16 is lifted and lowered, so that an intrusion amount of the drawing belt 16 with respect to the sheet P stacked on the stacking tray 6 changes. Note that the intrusion amount of the drawing belt 16 is the difference between the distance between the nip position of the belt-driving-roller pair 15 and the lower edge of the drawing belt 16 in the up-down direction in a state where the drawing belt 16 is not in contact with the sheet, and the distance between the nip position of the belt-driving-roller pair 15 and the lower edge of the drawing belt 16 in the up-down direction in a state where the drawing belt 16 is in contact with the sheet. That is, the intrusion amount of the drawing belt 16 is the amount of elastic deformation of the drawing belt 16 caused by the drawing belt 16 contacting the sheet P.

The belt-driving-roller pair 15 can move between a lower position at which the drawing belt 16 is in an intruding state, and an upper position to which the drawing belt 16 is retracted upward. In the intruding state, the drawing belt 16 is pressed against (as if it intrudes into) the sheet P stacked on the stacking tray 6. That is, the belt lifting/lowering motor 312 lifts and lowers the belt-driving-roller pair 15 between the lower position (i.e., a first position) and the upper position (i.e., a second position). The lower position is a position for causing the drawing belt 16 to contact the sheet P stacked on the stacking tray 6. The upper position is above the first position. The upper position in the present embodiment is a position at which the drawing belt 16 is in a state (i.e., a non-contact state) where the drawing belt 16 is separated upward from the sheet P stacked on the stacking tray 6.

The drawing belt 16 is referred to also as an alignment belt that aligns the sheet P. The drawing belt 16 may be a knurled belt on which a knurling process (i.e., a process for producing protrusions and indentations) was performed for adjusting the frictional force to the sheet P.

As illustrated in FIG. 2, the stacker 100 includes a belt driving motor 310 and a sheet detection portion 311. The belt driving motor 310 serves as a driving source that drives and rotates the drawing belt 16 via the belt-driving-roller pair 15. The sheet detection portion 311 detects the sheet P. The sheet detection portion 311 includes a plurality of sensors, each of which can detect the sheet. Each sensor may be an optical sensor that is disposed at a predetermined position (detection position) on the conveyance path in the stacker 100, and that optically detects the sheet P at the detection position. The sheet detection portion 311 includes the above-described sheet-top-surface sensor. Thus, the stacker control portion 210 can obtain the information, such as the current position of the sheet P in the stacker 100 and the amount of sheets stacked on the stacking tray 6, depending on the detection signal from each sensor of the sheet detection portion 311.

The side-edge regulation member 18 is a regulation member that regulates the position of the sheet P (stacked on the stacking tray 6) in the sheet width direction. The side-edge regulation member 18 of the present embodiment is a pair of regulation members that can move between a regulation position and a retracting position (i.e., a sheet receiving position). The regulation position is a position at which the side-edge regulation member 18 regulates the side-edge position of the sheet P. The retracting position is a position to which the side-edge regulation member 18 is retracted outward from the regulation position in the sheet width direction. The regulation position corresponds to a length (i.e., a sheet width) of the sheet P in the sheet width direction.

Operation of Stacker

Next, the operation of the stacker 100 will be described with reference to FIG. 3. If the sheet P is discharged from the image forming apparatus body 901, the inlet roller pair 1 receives the sheet P. The sheet P is guided to a predetermined conveyance path by the first switching member 2 and the second switching member 21. The predetermined conveyance path is determined in accordance with the job setting which is set in advance via the operation portion 209 or the like. If the place where the sheet P is to be stacked is set, in the job setting to an apparatus (e.g., a sheet processing apparatus) connected to the stacker 100 and located downstream of the stacker 100, the sheet P passes through the conveyance path 3 and is discharged to the apparatus by the outlet roller pair 4. If the place where the sheet P is to be stacked is set, in the job setting to the sample tray 9, the sheet P is discharged to the sample tray 9.

If the place where the sheet P is to be stacked is set, in the job setting to the stacking tray 6, the stacker 100 performs the below-described sheet stacking operation (i.e., a stacking process). First, the sheet P sent from the inlet roller pair 1 is guided to the discharging roller pair 5 by the first switching member 2. The rotation of the gripper belt 8 is controlled so as to synchronize with the timing at which the sheet P is sent from the discharging roller pair 5, so that the leading edge of the sheet P sent from the discharging roller pair 5 is held by one of the two grippers 7*a* and 7*b*. The following description will be made for a case where the sheet P is held by the gripper 7*a*.

The sheet P is conveyed through a space above the stacking tray 6, in the sheet conveyance direction 13, in a state where the sheet P is held by the discharging roller pair 5 and the gripper 7*a*. If a leading edge Pa of the sheet P abuts against the abutment slope 14*a* of the leading-edge stopper 14 as illustrated in FIG. 4A, the leading edge Pa of the sheet P is released from the gripper 7*a*, and the sheet P moves toward the drawing belt 16 along the abutment slope 14*a*.

Note that the distance from a nip position of the discharging roller pair 5 to a contact position L1 of the drawing belt 16 in the sheet conveyance direction 13 is shorter than the sheet length of the sheet P to be stacked on the stacking tray 6. The contact position L1 is a central position of the contact area between the drawing belt 16 and the sheet P The leading-edge stopper 14 and the drawing belt 16 are moved in advance, based on the job setting, to positions that correspond to the length (hereinafter, referred to simply as a sheet length) of the sheet P along the sheet conveyance direction 13 of the sheet P to be stacked on the stacking tray 6. In addition, the position (i.e., a stacking position) of the stacking tray 6 positioned when the sheet P is discharged to the stacking tray 6 is controlled so as to have a height at which the drawing belt 16 contacts the top surface of the stack of sheets stacked on the stacking tray 6.

Thus, after the leading edge Pa of the sheet P is released from the gripper 7*a* and before the trailing edge of the sheet P passes through the discharging roller pair 5, the leading edge Pa of the sheet P contacts the drawing belt 16, and receives from the drawing belt 16, the force (conveyance force) applied in the sheet conveyance direction 13. Since the sheet P is moved in the sheet conveyance direction 13 by the drawing belt 16, the leading edge Pa of the sheet P is abutted against the leading-edge abutment surface 14*b* of the leading-edge stopper 14. With this operation, the position of the sheet P is aligned in the sheet conveyance direction 13. If the sheet P is skewed, the skew of the sheet P is corrected so that the leading edge Pa is aligned with the leading-edge abutment surface 14*b*. The trailing edge of the sheet P passes through the discharging roller pair 5 before the leading edge Pa of the sheet P is abutted against the leading-edge stopper 14.

In a case where the image forming apparatus 900 performs a job (consecutive jobs) in which images are consecutively formed on a plurality of sheets P and the sheets P are consecutively stacked on the stacker 100, the above-described operation is performed repeatedly. In a case where a user takes out the sheets P from the stacker 100, the user operates the operation portion 209 (or an open-and-close button disposed on the stacker 100), and thereby makes the state of the stacker 100 become an open state in which the user can access the stacking tray 6 of the stacker 100. In this case, the stacker control portion 210 (FIG. 2) that has received the user operation lowers the stacking tray 6 from the stacking position to a lower position at which the user can take out the sheets P.

Note that the side-edge regulation member 18 is driven such that the side-edge regulation member 18 moves to the retracting position before the sheet P is discharged to the stacking tray 6, and moves to the regulation position after the leading edge Pa of the sheet P is abutted against the leading-edge abutment surface 14*b* of the leading-edge stopper 14 by the drawing belt 16. With these operations, the alignment of the stack of sheets stacked on the stacking tray 6 is kept in the sheet conveyance direction 13 and the sheet width direction.

Wobbling of Drawing Belt

Next, a case where the alignment of sheets deteriorates in the stacker 100 will be described. As described above, in the present embodiment, the sheets are aligned by abutting the leading edge Pa of the sheet P stacked on the stacking tray 6, against the leading-edge abutment surface 14*b* of the leading-edge stopper 14 by the drawing belt 16. In such a configuration, there is a possibility that the sheet P moves in the sheet width direction after the leading edge Pa of the sheet P is abutted against the leading-edge abutment surface 14*b*, due to wobbling of the drawing belt 16.

Figure 4B:
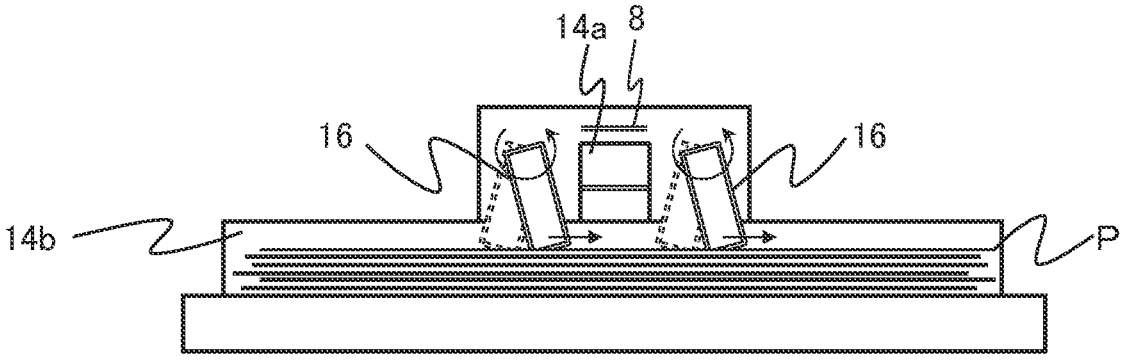
FIG. 4B is a diagram of a drawing belt viewed from the upstream side.

The more specific description will be made with reference to FIG. 4B. FIG. 4B is a diagram of the drawing belt 16 viewed from the upstream side in the sheet conveyance direction 13. When the sheet stacking operation is performed, the drawing belt 16 is in contact with the top surface of the sheets P stacked on the stacking tray 6. Since the drawing belt 16 has elasticity, the contact between the drawing belt 16 and the top surface of the sheets P is not necessarily stable. Thus, the drawing belt 16 may wobble due to the deformation of the drawing belt 16. The wobbling, which can also be called snaking or shaking) of the drawing belt 16 means the change in the position of the contact portion of the drawing belt 16 to the sheet P, in the sheet width direction (i.e., the right-left direction in FIG. 4B) in the rotation of the drawing belt 16. If the drawing belt 16 wobbles, not only the force in the sheet conveyance direction 13, but also the force in the sheet width direction is applied from the drawing belt 16 to the sheet P.

Before the leading edge Pa of the sheet P is abutted against the leading-edge abutment surface 14*b*, the sheet P is basically moved in the sheet conveyance direction 13 by the force applied by the discharging roller pair 5 and the inertia of the sheet P itself. However, if the leading edge Pa of the sheet P is abutted against the leading-edge abutment surface 14*b*, the sheet P is prevented from moving in the sheet conveyance direction 13. Thus, after the leading edge Pa of the sheet P is abutted against the leading-edge abutment surface 14*b*, the sheet position is changed in the sheet width direction by the force applied to the sheet P in the sheet width direction due to the wobbling of the drawing belt 16. As a result, the alignment of sheets may deteriorate.

Thus, the present embodiment proposes a configuration in which the possibility that the sheet position changes in the sheet width direction after the leading edge Pa of the sheet P is abutted against the leading-edge abutment surface 14*b* can be reduced.

Sequence of Sheet Stacking Operation

Figure 5:
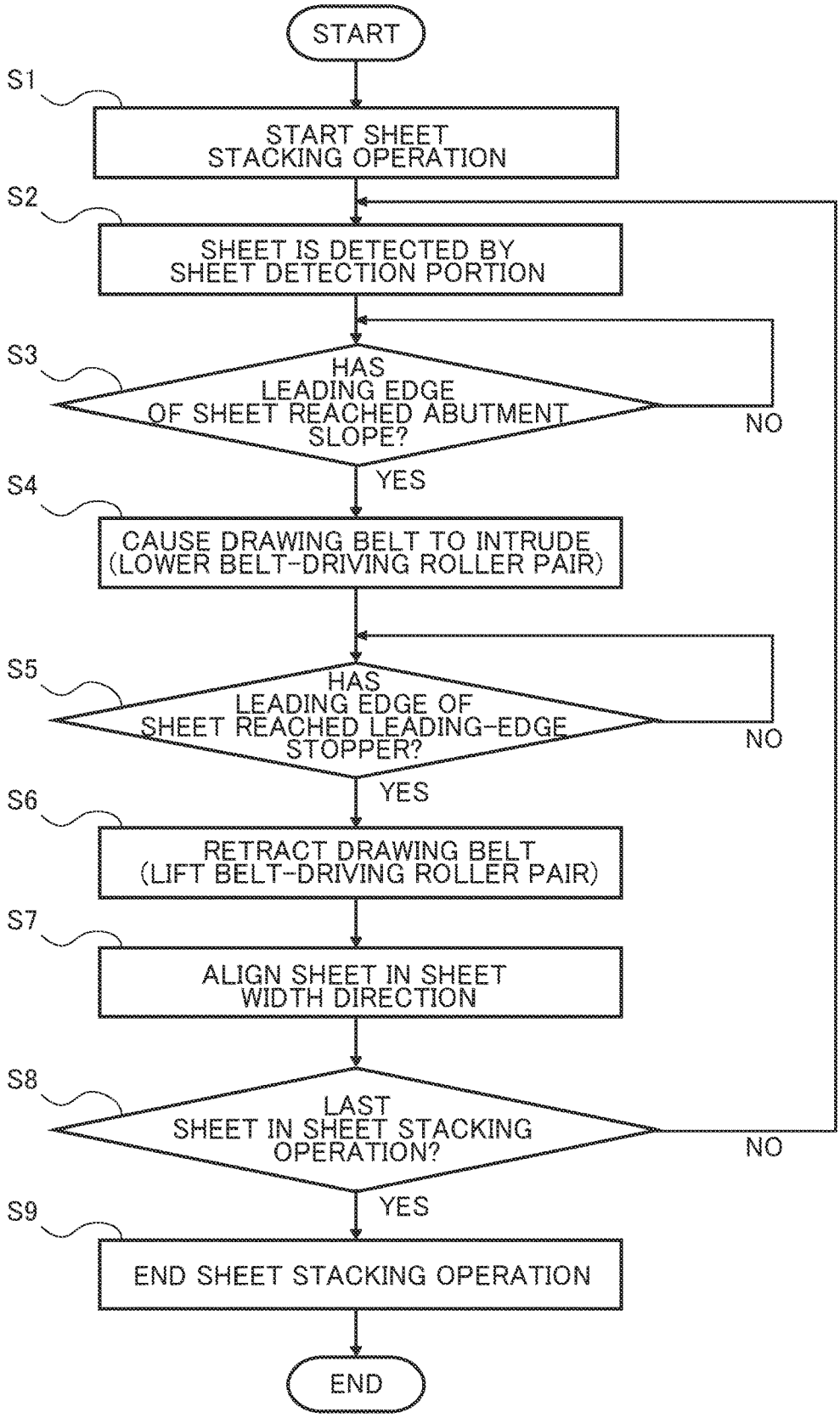
FIG. 5 is a flowchart illustrating an example of control of the stacker of the first embodiment.
Figure 6A:
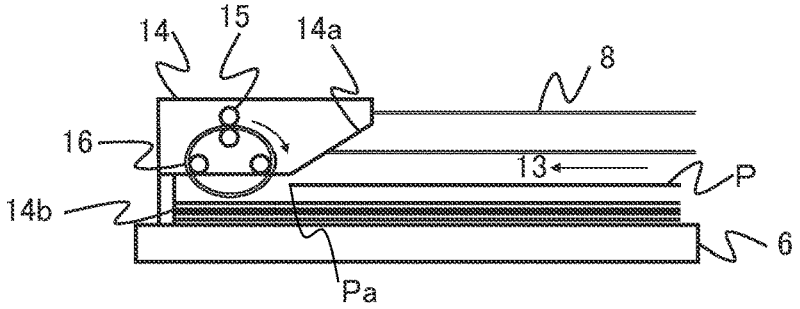
FIG. 6A is a diagram for illustrating an operation of the stacker of the first embodiment.
Figure 6B:
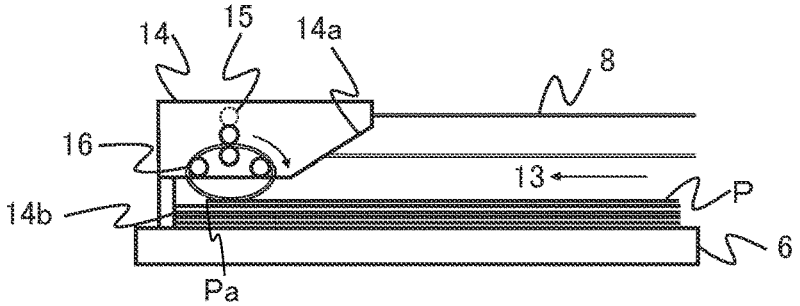
FIG. 6B is a diagram for illustrating the operation of the stacker of the first embodiment.
Figure 6C:
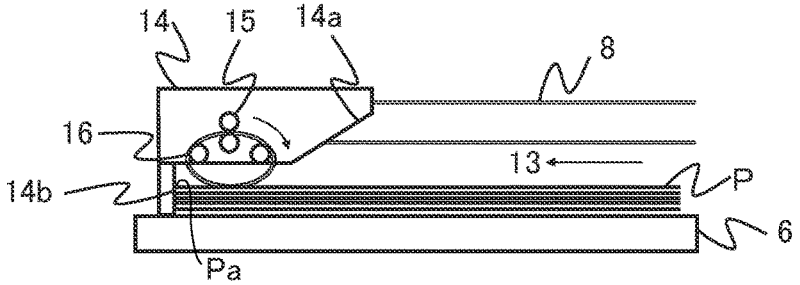
FIG. 6C is a diagram for illustrating the operation of the stacker of the first embodiment.
Figure 6D:
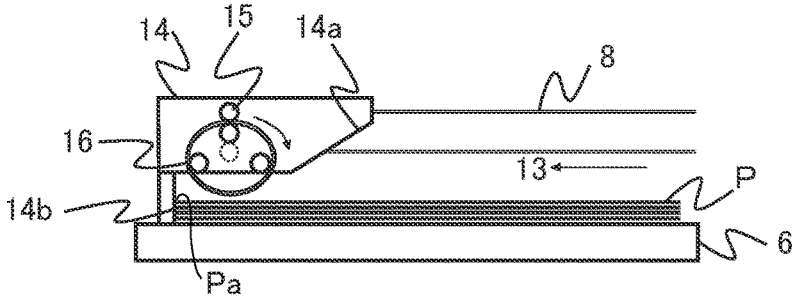
FIG. 6D is a diagram for illustrating the operation of the stacker of the first embodiment.
Figure 6E:
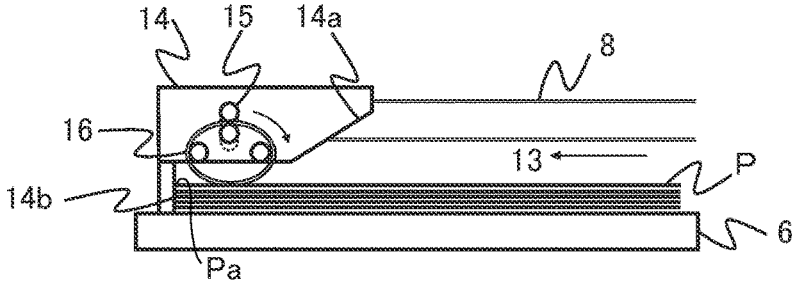
FIG. 6E is a diagram for illustrating a modification.

Next, a sequence of the sheet stacking operation of the present embodiment will be described. FIG. 5 is a flowchart illustrating an example of the sequence of the present embodiment. FIG. 6A illustrates a state after a sheet P discharged newly to the stacking tray 6 abuts against the abutment slope 14*a* of the leading-edge stopper 14 and before the sheet P contacts the drawing belt 16. FIG. 6B illustrates a state after the sheet P contacts the drawing belt 16 and before the leading edge Pa of the sheet P abuts against the leading-edge abutment surface 14*b*. FIG. 6C illustrates a state when the leading edge Pa of the sheet P abuts against the leading-edge abutment surface 14*b*. FIG. 6D illustrates a state after the leading edge Pa of the sheet P abuts against the leading-edge abutment surface 14*b* and before the next sheet P (i.e., the following sheet) is discharged to the stacking tray 6. FIG. 6E is a diagram for illustrating a modification, and will be described later.

Hereinafter, the description will be made with reference to a flowchart of FIG. 5. Each process illustrated in the below-described flowchart is performed by the stacker control portion 210, unless otherwise specified, depending on an instruction from the control portion 960 of the image forming apparatus body 901. In addition, the stacker control portion 210 controls the intrusion amount of the drawing belt 16 with respect to the sheet P stacked on the stacking tray 6, by performing the lifting/lowering control on the belt-driving-roller pair 15 via the belt lifting/lowering motor 312 (FIG. 2).

If an image forming job that include a job setting for stacking the sheet P on the stacking tray 6 is given to the image forming apparatus 900, the stacker control portion 210 starts the sheet stacking operation, depending on an instruction from the control portion 960 of the image forming apparatus body 901 (S1). With the start of the sheet stacking operation, the drawing belt 16 is driven and rotated at a predetermined rotational speed by the belt driving motor 310. A single sheet P (hereinafter referred to as a current sheet P) is discharged from the image forming apparatus body 901, and is conveyed toward the stacking tray 6 by the discharging roller pair 5. In the process in which the current sheet P is conveyed, the stacker control portion 210 collects the position information of the current sheet P in the sheet conveyance direction 13 by using the sheet detection portion 311 (FIG. 2) (S2). Depending on the position information of the sheet P collected by using the sheet detection portion 311, the stacker control portion 210 can determine the timing of the below-described lifting/lowering control of the drawing belt 16.

Note that in a period of time before the leading edge Pa of the current sheet P abuts against the abutment slope 14*a* (S1 to S3: NO), the belt-driving-roller pair 15 is positioned at the upper position.

Then, the stacker control portion 210 waits until a timing at which the leading edge Pa of the current sheet P abuts against the abutment slope 14*a*. If the leading edge Pa abuts against the abutment slope 14*a*, the current sheet P is released from the gripper 7*a* or 7*b* (FIG. 6A). The stacker control portion 210 determines that the leading edge Pa of the current sheet P has abutted against the abutment slope 14*a*, on the basis of a detection result of the sheet detection portion 311 (S3: YES). After that, the stacker control portion 210 sets the state of the drawing belt 16 to the intruding state by moving the belt-driving-roller pair 15 from the upper position to the lower position (S4). In other words, on the basis of a detection result of the sheet detection portion, the controller of the present embodiment lowers the nipping portion from the upper position (i.e., a second position) to the lower position (i.e., a first position) when the leading edge of the current sheet abuts against the abutment surface. As a result, the current sheet P contacts the drawing belt 16 that is rotating at a predetermined speed, so that the current sheet P is moved in the sheet conveyance direction 13 by the force (conveyance force) that the current sheet P receives from the drawing belt 16 (FIG. 6B). After that, the leading edge Pa of the current sheet P is abutted against the leading-edge abutment surface 14*b* of the leading-edge stopper 14, so that the current sheet P is aligned in the sheet conveyance direction 13 (FIG. 6C).

Note that the predetermined speed of the drawing belt 16 is set slower than the rotational speed of the gripper belt 8. The rotational speed of the discharging roller pair 5 and the gripper belt 8 (i.e., the sheet conveyance speed in the stacker 100) is set faster than the sheet conveyance speed in the image forming apparatus body 901, for increasing the productivity of the image forming apparatus 900. Thus, if the speed of the sheet P obtained when the sheet P abuts against the leading-edge stopper 14 is too fast, a folded corner or the like may occur. Thus, it is preferable that the predetermined speed of the drawing belt 16 be slower than the rotational speed of the gripper belt 8.

The stacker control portion 210 determines that the leading edge Pa of the current sheet P has abutted against the leading-edge abutment surface 14*b* (S5: YES). Then, the stacker control portion 210 moves the belt-driving-roller pair 15 from the lower position to the upper position, and thereby retracts the drawing belt 16 upward from the current sheet P (S6, FIG. 6D). In other words, on the basis of a detection result of the sheet detection portion, the controller of the present embodiment lifts the nipping portion from the lower position (i.e., a first position) to the upper position (i.e., a second position) when the leading edge of the current sheet abuts against the abutment portion. In addition, after the stacker control portion 210 moves the belt-driving-roller pair 15 from the lower position to the upper position, the stacker control portion 210 moves the side-edge regulation member 18 from the retracting position to the regulation position, and thereby aligns the current sheet P in the sheet width direction (S7). Note that the side-edge regulation member 18 is moved from the regulation position to the retracting position before the next sheet P is conveyed to the stacking tray 6.

If the current sheet P is not the last sheet in the sheet stacking operation (S8: NO), then the stacker control portion 210 returns to the step S2 and repeats the same processes (S2 to S7) for each sheet. If the current sheet P is the last sheet in the sheet stacking operation (S8: YES), then the stacker control portion 210 ends the sheet stacking operation (S9). With the end of the sheet stacking operation, the rotation of the drawing belt 16 by the belt driving motor 310 is stopped.

Note that in the present embodiment, the belt-driving-roller pair 15 is positioned at the lower position before the leading edge Pa of the current sheet P abuts against the leading-edge abutment surface 14*b*, and is positioned at the upper position after the leading edge Pa of the current sheet P abuts against the leading-edge abutment surface 14*b*.

Thus, after the drawing belt 16 contacts the current sheet P and before the leading edge Pa of the current sheet P abuts against the leading-edge abutment surface 14*b*, the stacker control portion 210 positions the belt-driving-roller pair 15 at the lower position (i.e., a first position)(FIG. 6B). In addition, after the leading edge Pa of the current sheet P abuts against the leading-edge abutment surface 14*b* and before the drawing belt 16 contacts the next sheet following the current sheet P, the stacker control portion 210 positions the belt-driving-roller pair 15 at the upper position (i.e., a second position) (FIG. 6D).

In other words, the controller of the present embodiment controls the lifting/lowering unit such that the nipping portion is positioned at the first position after the belt member contacts the current sheet and before the leading edge of the current sheet abuts against the abutment portion, and is positioned at the second position after the leading edge of the current sheet abuts against the abutment portion and before the belt member contacts the next sheet following the current sheet.

In this configuration, after the leading edge Pa of the current sheet P abuts against the leading-edge abutment surface 14*b*, it is difficult for the drawing belt 16 to apply the force to the current sheet P in the sheet width direction. As a result, the possibility that the alignment of sheets deteriorates in the sheet width direction can be reduced. That is, the present embodiment can provide a sheet stacking apparatus and an image forming apparatus that can improve the alignment of sheets.

By the way, as the weight of a single sheet P to be stacked on the stacking tray 6 increases, the conveyance resistance for moving the sheet P in the sheet conveyance direction 13 increases. In this case, the amount of actual movement of the sheet P decreases with respect to the amount of conveyance by the drawing belt 16. If the contact pressure of the drawing belt 16 in the intruding state or the time in which the intruding state is kept is set constant regardless of the sheet information, the leading edge Pa of a single sheet P with more weight may not reach the leading-edge abutment surface 14*b*. In this case, the alignment of sheets deteriorates in the sheet conveyance direction 13. In addition, if the contact pressure of the drawing belt 16 in the intruding state or the time in which the intruding state is kept is set constant regardless of the sheet information, the drawing belt 16 may continue to rotate in the intruding state even after the leading edge Pa of a single sheet P with less weight reaches the leading-edge abutment surface 14*b*. In this case, the alignment of sheets may deteriorate in the sheet width direction, due to the wobbling of the drawing belt 16.

For this reason, depending on the sheet information in the job setting, the stacker control portion 210 may change the intrusion amount of the drawing belt 16 or the time in which the intruding state of the drawing belt 16 is kept (the intrusion amount of the drawing belt 16 and the time are obtained when the belt-driving-roller pair 15 is positioned at the lower position). Specifically, the height of the lower position of the belt-driving-roller pair 15 or the time in which the belt-driving-roller pair 15 is kept at the lower position may be changed in accordance with at least one of the grammage, size, and material of the sheet.

As an example, the lower position for stacking a sheet with a second grammage larger than a first grammage is set lower than the lower position for stacking a sheet with the first grammage. That is, the lower position for stacking a sheet with the first grammage is set higher than the lower position for stacking a sheet with the second grammage larger than the first grammage. With this operation, the intrusion amount (contact pressure) of the drawing belt 16 becomes smaller for a sheet with the first grammage and less weight, and becomes larger for a sheet with the second grammage and more weight. Thus, the alignment can be improved for both of the sheet with the first grammage and the sheet with the second grammage.

In another case, as an example, the timing at which the belt-driving-roller pair 15 is retracted from the lower position to the upper position in a case where a sheet with the second grammage larger than the first grammage is stacked is delayed from the timing at which the belt-driving-roller pair 15 is retracted from the lower position to the upper position in a case where a sheet with the first grammage is stacked. That is, the timing at which the belt-driving-roller pair 15 is retracted from the lower position to the upper position in a case where a sheet with the first grammage is stacked is set to an earlier timing than the timing at which the belt-driving-roller pair 15 is retracted from the lower position to the upper position in a case where a sheet with the second grammage larger than the first grammage is stacked. With this operation, the time in which the intruding state of the drawing belt 16 is kept is made shorter for a sheet with the first grammage and less weight, and is made longer for a sheet with the second grammage and more weight. Thus, the alignment can be improved for both of the sheet with the first grammage and the sheet with the second grammage.

In addition, as an example, the lower position for stacking a sheet with a second size whose area is larger than that of a first size is set lower than the lower position for stacking a sheet with the first size. That is, the lower position for stacking a sheet with the first size is set higher than the lower position for stacking a sheet with the second size whose area is larger than that of the first size. With this operation, the intrusion amount (contact pressure) of the drawing belt 16 becomes smaller for a sheet with the first size and less weight, and becomes larger for a sheet with the second size and more weight. Thus, the alignment can be improved for both of the sheet with the first size and the sheet with the second size.

In another case, as an example, the timing at which the belt-driving-roller pair 15 is retracted from the lower position to the upper position in a case where a sheet with the second size whose area is larger than that of the first size is stacked is delayed from the timing at which the belt-driving-roller pair 15 is retracted from the lower position to the upper position in a case where a sheet with the first size is stacked. That is, the timing at which the belt-driving-roller pair 15 is retracted from the lower position to the upper position in a case where a sheet with the first size is stacked is set to an earlier timing than the timing at which the belt-driving-roller pair 15 is retracted from the lower position to the upper position in a case where a sheet with the second size whose area is larger than that of the first size is stacked. With this operation, the time in which the intruding state of the drawing belt 16 is kept is made shorter for a sheet with the first size and less weight, and is made longer for a sheet with the second size and more weight. Thus, the alignment can be improved for both of the sheet with the first size and the sheet with the second size.

In addition, as an example, the lower position for stacking a sheet with a second material whose density is larger than that of a first material is set lower than the lower position for stacking a sheet with the first material. That is, the lower position for stacking a sheet with the first material is set higher than the lower position for stacking a sheet with the second material whose density is larger than that of the first material. With this operation, the intrusion amount (contact pressure) of the drawing belt 16 becomes smaller for a sheet with the first material and less weight, and becomes larger for a sheet with the second material and more weight. Thus, the alignment can be improved for both of the sheet with the first material and the sheet with the second material. Note that an example of the sheet with the first material is a plain paper sheet, and an example of the sheet with the second material is a coated paper sheet whose density is generally larger than that of the plain paper sheet. In addition, another example of the sheet with the first material is a recycled paper sheet, and another example of the sheet with the second material is a plain paper sheet whose density is generally larger than that of the recycled paper sheet.

In another case, as an example, the timing at which the belt-driving-roller pair 15 is retracted from the lower position to the upper position in a case where a sheet with the second material whose density is larger than that of the first material is stacked is delayed from the timing at which the belt-driving-roller pair 15 is retracted from the lower position to the upper position in a case where a sheet with the first material is stacked. That is, the timing at which the belt-driving-roller pair 15 is retracted from the lower position to the upper position in a case where a sheet with the first material is stacked is set to an earlier timing than the timing at which the belt-driving-roller pair 15 is retracted from the lower position to the upper position in a case where a sheet with the second material whose density is larger than that of the first material is stacked. With this operation, the time in which the intruding state of the drawing belt 16 is kept is made shorter for a sheet with the first material and less weight, and is made longer for a sheet with the second material and more weight. Thus, the alignment can be improved for both of the sheet with the first material and the sheet with the second material.

In addition, in the present embodiment, the side-edge regulation member 18 is moved from the retracting position to the regulation position after the belt-driving-roller pair 15 is retracted from the lower position to the upper position. If the drawing belt 16 is rotated in a state where the belt-driving-roller pair 15 is positioned at the lower position even after the sheet is aligned in the sheet width direction by the side-edge regulation member 18, the alignment of the sheet may deteriorate in the sheet width direction. In the present embodiment, however, since the sheet is aligned in the sheet width direction by the side-edge regulation member 18 after the belt-driving-roller pair 15 is retracted from the lower position to the upper position, the possibility that the alignment of sheets deteriorates can be reduced.

Modification 1

In the above-described embodiment, the description has been made, as an example, for the case where the belt-driving-roller pair 15 is moved from the upper position to the lower position when the leading edge Pa of the current sheet P abuts against the abutment slope 14*a*. In addition, in the above-described embodiment, the description has been made, as an example, for the case where the belt-driving-roller pair 15 is retracted from the lower position to the upper position when the leading edge Pa of the current sheet P abuts against the leading-edge abutment surface 14*b*. However, the timing at which the belt-driving-roller pair 15 is lifted and lowered is not limited to the above-described timings.

That is, in at least a part of a period of time after the leading edge Pa of the current sheet P abuts against the leading-edge abutment surface 14*b* and before the next sheet following the current sheet P contacts the drawing belt 16, the belt-driving-roller pair 15 has only to be positioned at the upper position. With this operation, the possibility that the sheet P moves in the sheet width direction due to the wobbling of the drawing belt 16 after the leading edge Pa of the current sheet P abuts against the leading-edge abutment surface 14*b* can be reduced.

As an example, in consideration of the response time of the belt lifting/lowering motor 312 (FIG. 2), the belt-driving-roller pair 15 may be moved from the lower position to the upper position before the leading edge Pa of the current sheet P abuts against the leading-edge abutment surface 14*b*. In addition, as an example, for more reliably abutting the leading edge Pa of the sheet P against the leading-edge abutment surface 14*b* and correcting the skew of the sheet P, the timing at which the belt-driving-roller pair 15 is moved from the lower position to the upper position may be delayed from a theoretical timing at which the leading edge Pa abuts against the leading-edge abutment surface 14*b*. The theoretical timing is estimated, based on the time that has elapsed since the position of the sheet P was detected last by the sheet detection portion 311, the rotational speed (circumferential speed) of each of the gripper belt 8 and the drawing belt 16, the estimated amount of slip between the drawing belt 16 and the sheet P, and the like.

The belt-driving-roller pair 15 has only to be positioned at the lower position in at least a part of a period of time after the current sheet P abuts against the drawing belt 16 and before the leading edge Pa of the current sheet P abuts against the leading-edge abutment surface 14*b*. With this operation, the rotating drawing belt 16 can move the sheet P toward the leading-edge abutment surface 14*b*. For example, the drawing belt 16 may be moved from the upper position to the lower position at a timing at which the leading edge Pa of the sheet P reaches the contact position L1 (FIG. 4A) of the drawing belt 16 after the leading edge Pa of the sheet P abuts against the abutment slope 14*a*.

Modification 2

In the above-described embodiment, the description has been made, as an example, for the configuration in which the drawing belt 16 is separated upward from the sheet P on the stacking tray 6 in a case where the belt-driving-roller pair 15 is positioned at the upper position. However, the present disclosure is not limited to this. For example, in a state where the belt-driving-roller pair 15 is positioned at the upper position, the drawing belt 16 may be in contact with the sheet P stacked on the stacking tray 6. That is, as illustrated in FIG. 6E, in a case where the belt-driving-roller pair 15 is positioned at the upper position, the drawing belt 16 may be in contact with the sheet P stacked on the stacking tray 6, at a contact pressure lower than a contact pressure at which the drawing belt 16 is in contact with the sheet P on the stacking tray 6 when the belt-driving-roller pair 15 is positioned at the lower position. Even in this configuration, since the force that the drawing belt 16 applies to the current sheet P in the sheet width direction after the leading edge Pa of the current sheet P abuts against the leading-edge abutment surface 14*b* is reduced, the alignment of sheets can be improved.

In the present modification, the moving distance by which the belt-driving-roller pair 15 is moved between the upper position and the lower position becomes shorter than the moving distance in the above-described embodiment. As a result, the time for driving the belt lifting/lowering motor 312 is shortened. Thus, even in a case where a small-sized motor with lower output is used as the belt lifting/lowering motor 312, the deterioration in throughput of the sheet stacking operation, which is caused by the time for driving the belt lifting/lowering motor 312, can be avoided.

Modification 3

In the above-described embodiment, the description has been made, as an example, for the configuration in which the leading edge of the sheet is held by the gripper 7*a* or 7*b*, and in which the leading edge of the sheet is released from the gripper 7*a* or 7*b* by the leading edge of the sheet abutting against the abutment slope 14*a*. However, the present disclosure is not limited to this. For example, instead of the configuration in which the leading edge of the sheet is abutted against the abutment slope 14*a*, a configuration in which the grippers 7*a* and 7*b* can open and close may be used. In this configuration, the sheet may be released by the gripper 7*a* or 7*b* being opened when the leading edge of the sheet approaches the leading-edge abutment surface 14*b*.

In another case, the grippers 7*a* and 7*b* and the gripper belt 8 may not be disposed, and the discharging roller pair 5 may directly convey the sheet onto the stacking tray 6. In another case, the direction in which the discharging roller pair 5 conveys the sheet may be different from the direction in which the drawing belt 16 conveys the sheet. For example, the discharging roller pair 5 may convey the sheet in a direction opposite to the direction in which the drawing belt 16 moves the sheet toward the leading-edge stopper 14, and discharge the sheet to the stacking tray 6. In this case, the sheet discharged to the stacking tray 6 may be moved toward the leading-edge stopper 14 in the sheet conveyance direction by a conveyance member (such as a paddle or a roller), and then the sheet may be abutted against the leading-edge stopper 14 by the drawing belt 16.

Second Embodiment

In the above-described first embodiment, the description has been made for the case where the rotational speed of the drawing belt 16 is constant in the sheet stacking operation. In a second embodiment, the description will be made for a configuration in which the alignment of sheets can be further improved by controlling the rotational speed of the drawing belt 16 in the sheet stacking operation, in addition to controlling the intrusion amount of the drawing belt 16. Hereinafter, a component given a reference symbol identical to a reference symbol of a component of the first embodiment has substantially the same structure and function as those of the component described in the first embodiment, and features different from the features of the first embodiment will be mainly described.

Sequence of Sheet Stacking Operation

Figure 7:
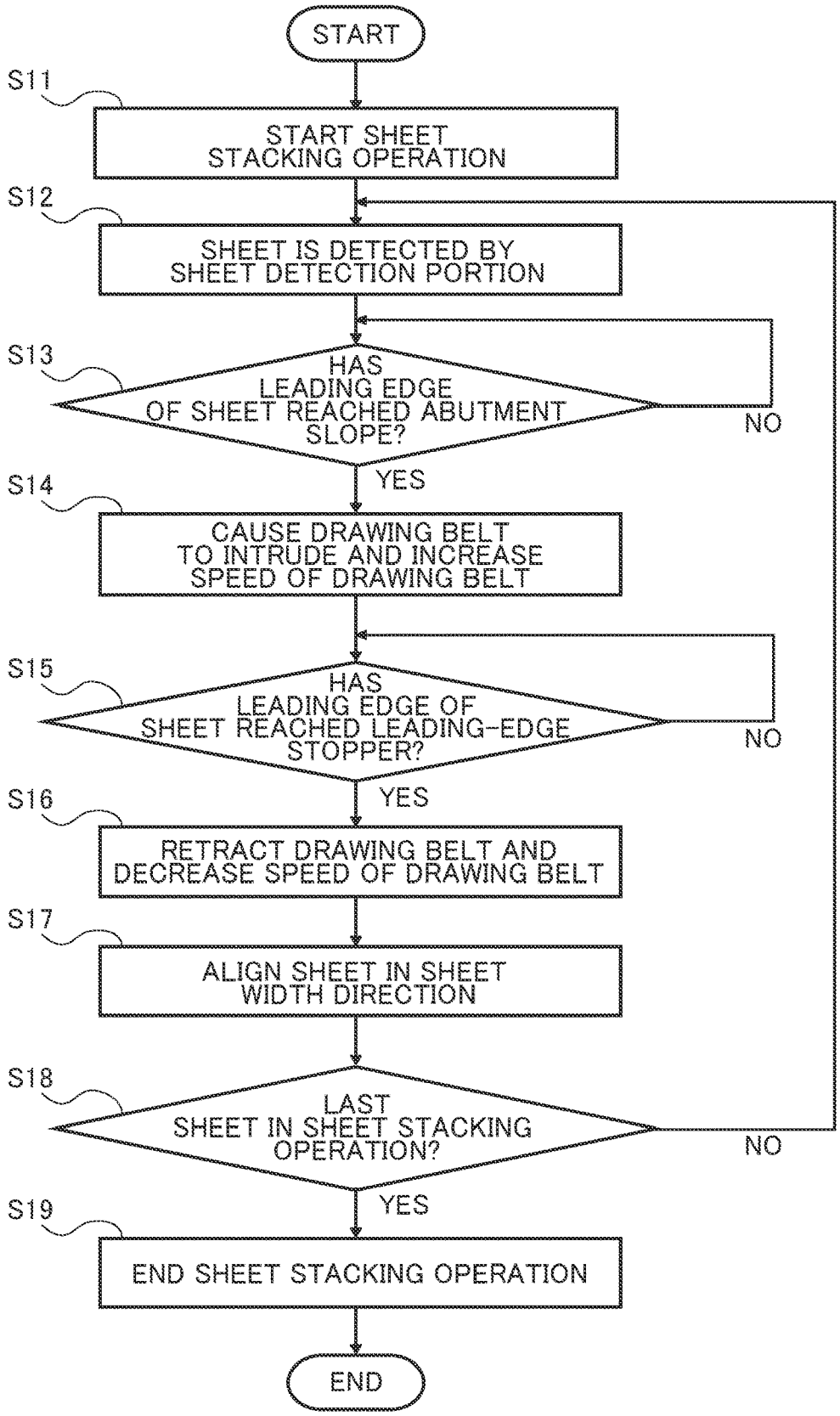
FIG. 7 is a flowchart illustrating an example of control of a stacker of a second embodiment.
Figure 8A:
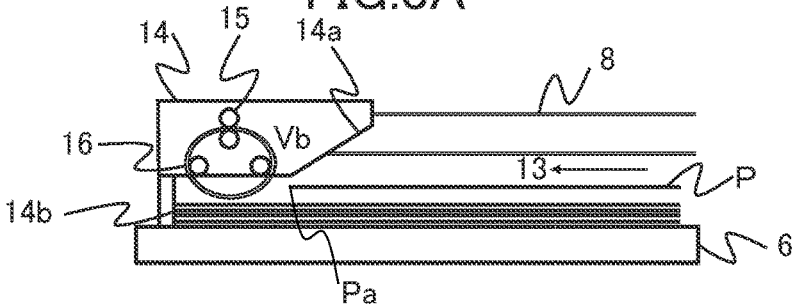
FIG. 8A is a diagram for illustrating an operation of the stacker of the second embodiment.
Figure 8B:
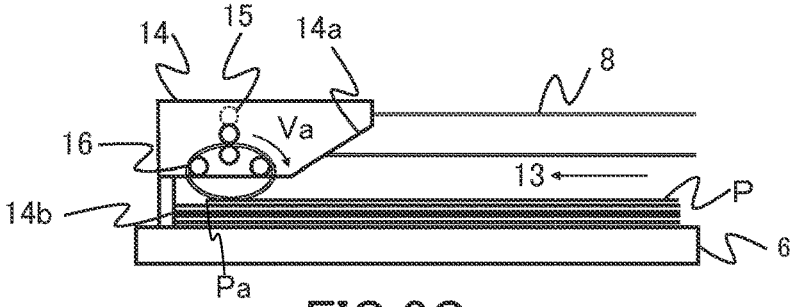
FIG. 8B is a diagram for illustrating the operation of the stacker of the second embodiment.
Figure 8C:
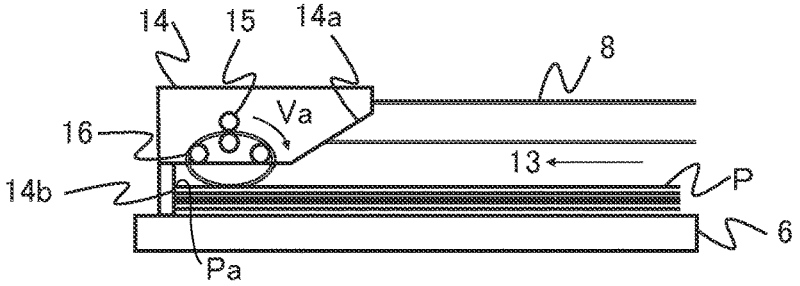
FIG. 8C is a diagram for illustrating the operation of the stacker of the second embodiment.
Figure 8D:
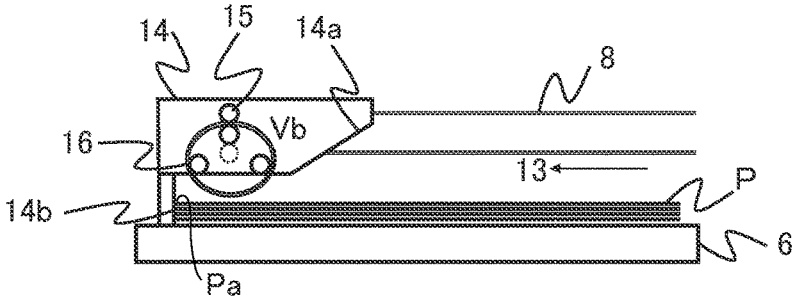
FIG. 8D is a diagram for illustrating the operation of the stacker of the second embodiment.
Figure 8E:
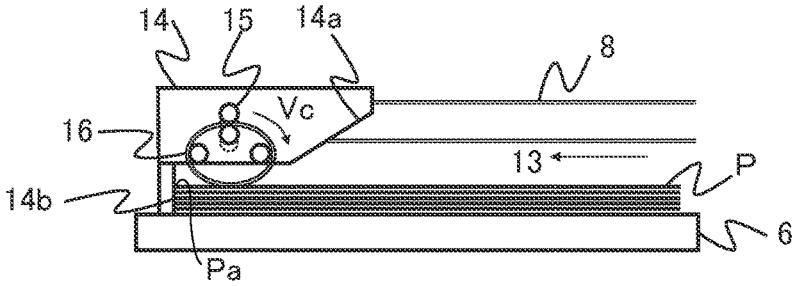
FIG. 8E is a diagram for illustrating a modification.

Next, a sequence of the sheet stacking operation of the present embodiment will be described. FIG. 7 is a flowchart illustrating an example of the sequence of the present embodiment. FIG. 8A illustrates a state after a sheet P discharged newly to the stacking tray 6 abuts against the abutment slope 14*a* of the leading-edge stopper 14 and before the sheet P contacts the drawing belt 16. FIG. 8B illustrates a state after the sheet P contacts the drawing belt 16 and before the leading edge Pa of the sheet P abuts against the leading-edge abutment surface 14*b*. FIG. 8C illustrates a state when the leading edge Pa of the sheet P abuts against the leading-edge abutment surface 14*b*. FIG. 8D illustrates a state after the leading edge Pa of the sheet P abuts against the leading-edge abutment surface 14*b* and before the next sheet (i.e., the following sheet) is discharged to the stacking tray 6. FIG. 8E is a diagram for illustrating a modification, and will be described later.

Hereinafter, the description will be made with reference to a flowchart of FIG. 7. Each process illustrated in the below-described flowchart is performed by the stacker control portion 210, unless otherwise specified, depending on an instruction from the control portion 960 of the image forming apparatus body 901. In addition, the stacker control portion 210 controls the intrusion amount of the drawing belt 16 with respect to the sheet P stacked on the stacking tray 6, by performing the lifting/lowering control on the belt-driving-roller pair 15 via the belt lifting/lowering motor 312 (FIG. 2). Furthermore, the stacker control portion 210 controls the rotational speed (circumferential speed) of the drawing belt 16 by driving and controlling the belt driving motor 310 (FIG. 2).

If an image forming job that include a job setting for stacking the sheet P on the stacking tray 6 is given to the image forming apparatus 900, the stacker control portion 210 starts the sheet stacking operation, depending on an instruction from the control portion 960 of the image forming apparatus body 901 (S11). A single sheet P (hereinafter referred to as a current sheet P) is discharged from the image forming apparatus body 901, and is conveyed toward the stacking tray 6 by the discharging roller pair 5. In the process in which the current sheet P is conveyed, the stacker control portion 210 collects the position information of the current sheet P in the sheet conveyance direction 13 by using the sheet detection portion 311 (FIG. 2) (S12). Depending on the position information collected by using the sheet detection portion 311, the stacker control portion 210 can determine the timing of the below-described speed control of the drawing belt 16.

Note that in a period of time before the leading edge Pa of the current sheet P abuts against the abutment slope 14*a* (S11 to S13: NO), the position of the belt-driving-roller pair 15 is set at the upper position and the rotational speed of the drawing belt 16 is set at a speed Vb.

Then, the stacker control portion 210 waits until a timing at which the leading edge Pa of the current sheet P abuts against the abutment slope 14*a*. If the leading edge Pa abuts against the abutment slope 14*a*, the current sheet P is released from the gripper 7*a* or 7*b* (FIG. 8A). The stacker control portion 210 determines that the leading edge Pa of the current sheet P has abutted against the abutment slope 14*a*, on the basis of a detection result of the sheet detection portion 311 (S13: YES). After that, the stacker control portion 210 sets the state of the drawing belt 16 to the intruding state by moving the belt-driving-roller pair 15 from the upper position to the lower position (S14). In addition, the stacker control portion 210 changes the rotational speed of the drawing belt 16 from the speed Vb to a speed Va (S14). In other words, on the basis of a detection result of the sheet detection portion, the controller of the present embodiment increases the speed of the belt member from the speed Vb (i.e., a second speed) to the speed Va (i.e., a first speed) when the leading edge of the current sheet abuts against the abutment surface. As a result, the current sheet P contacts the drawing belt 16 that is rotating at the speed Va, so that the current sheet P is moved in the sheet conveyance direction 13 by the force (conveyance force) that the current sheet P receives from the drawing belt 16 (FIG. 8B). After that, the leading edge Pa of the current sheet P is abutted against the leading-edge abutment surface 14*b* of the leading-edge stopper 14, so that the current sheet P is aligned in the sheet conveyance direction 13 (FIG. 8C).

Note that the speed Va of the drawing belt 16 is set slower than the rotational speed of the gripper belt 8. The rotational speed of the discharging roller pair 5 and the gripper belt 8 (i.e., the sheet conveyance speed in the stacker 100) is set faster than the sheet conveyance speed (i.e., the process speed) in the image forming apparatus body 901, for increasing the productivity of the image forming apparatus 900. Thus, if the speed of the sheet P obtained when the sheet P abuts against the leading-edge stopper 14 is too fast, a folded corner or the like may occur. Thus, it is preferable that the speed Va of the drawing belt 16 be slower than the rotational speed of the gripper belt 8.

The stacker control portion 210 determines that the leading edge Pa of the current sheet P has abutted against the leading-edge abutment surface 14*b* (S15: YES). Then, the stacker control portion 210 moves the belt-driving-roller pair 15 from the lower position to the upper position, and thereby retracts the drawing belt 16 upward from the current sheet P (S16, FIG. 8D). In addition, the stacker control portion 210 changes the rotational speed of the drawing belt 16 from the speed Va to the speed Vb (S16, FIG. 8D). In other words, on the basis of a detection result of the sheet detection portion, the controller of the present embodiment decreases the speed of the belt member from the speed Va (i.e., a first speed) to the speed Vb (i.e., a second speed) when the leading edge of the current sheet abuts against the abutment portion. In addition, after the stacker control portion 210 changes the rotational speed of the drawing belt 16 from the speed Va to the speed Vb, the stacker control portion 210 moves the side-edge regulation member 18 from the retracting position to the regulation position, and thereby aligns the current sheet P in the sheet width direction (S17). Note that the side-edge regulation member 18 is moved from the regulation position to the retracting position before the next sheet P is conveyed to the stacking tray 6.

If the current sheet P is not the last sheet in the sheet stacking operation (S18: NO), then the stacker control portion 210 returns to the step S12 and repeats the same processes (S12 to S17) for each sheet. If the current sheet P is the last sheet in the sheet stacking operation (S18: YES), then the stacker control portion 210 ends the sheet stacking operation (S19).

In the present embodiment, the speed Vb of the drawing belt 16 obtained after the leading edge Pa of the current sheet P abuts against the leading-edge abutment surface 14*b* is set slower than the speed Va of the drawing belt 16 obtained before the leading edge Pa of the current sheet P abuts against the leading-edge abutment surface 14*b*. Specifically, in the present embodiment, the speed Vb is set at 0 mm/sec, so that the rotation of the drawing belt 16 is temporarily stopped after the leading edge Pa of the current sheet P abuts against the leading-edge abutment surface 14*b*. Note that the rotation of the drawing belt 16 is restarted when the leading edge of the next sheet abuts against the abutment slope 14*a* (S13: Yes, S14).

Thus, after the drawing belt 16 contacts the current sheet P and before the leading edge Pa of the current sheet P abuts against the leading-edge abutment surface 14*b*, the stacker control portion 210 rotates the drawing belt 16 at the speed Va (i.e., a first speed) (FIG. 8B). In addition, in at least a part of a period of time after the leading edge Pa of the current sheet P abuts against the leading-edge abutment surface 14*b* and before the drawing belt 16 contacts the next sheet following the current sheet P, the stacker control portion 210 sets the rotational speed of the drawing belt 16 at the speed Vb (i.e., a second speed) slower than the speed Va (FIG. 8D). Thus, the stacker control portion 210 drives and controls the belt driving motor 310 for each sheet so that the rotational speed of the drawing belt 16 is set as described above.

In other words, the controller of the present embodiment drives and controls the driving source for each sheet such that (i) the belt member rotates at the first speed after the belt member contacts the current sheet and before the leading edge of the current sheet abuts against the abutment portion, and that (ii) the rotational speed of the belt member is set at the second speed slower than the first speed in at least a part of a period of time after the leading edge of the current sheet abuts against the abutment portion and before the belt member contacts the next sheet following the current sheet.

In this configuration, after the leading edge Pa of the current sheet P abuts against the leading-edge abutment surface 14*b*, the drawing belt 16 is less likely to apply the force to the current sheet P in the sheet width direction. As a result, the possibility that the alignment of sheets deteriorates in the sheet width direction can be reduced. That is, the present embodiment can provide a sheet stacking apparatus and an image forming apparatus that can improve the alignment of sheets.

By the way, as the weight of a single sheet P to be stacked on the stacking tray 6 increases, the conveyance resistance for moving the sheet P in the sheet conveyance direction 13 increases. In this case, the amount of actual movement of the sheet P decreases with respect to the amount of conveyance by the drawing belt 16. If the amount of conveyance by the drawing belt 16 is set constant, regardless of sheet information, the leading edge Pa of a single sheet P with more weight may not reach the leading-edge abutment surface 14*b*. In this case, the alignment of sheets deteriorates in the sheet conveyance direction 13. In addition, if the amount of conveyance by the drawing belt 16 is set constant, regardless of the sheet information, and if a single sheet P with less weight is conveyed, the drawing belt 16 may continue to rotate at the speed Va even after the leading edge Pa of the sheet P reaches the leading-edge abutment surface 14*b*. In this case, the alignment of sheets may deteriorate in the sheet width direction, due to the wobbling of the drawing belt 16.

For this reason, depending on the sheet information in the job setting, the stacker control portion 210 may change the amount of conveyance (i.e., the amount of driving of the belt-driving-roller pair 15) in which the drawing belt 16 is driven and rotated at the speed Va (i.e., the first speed). Specifically, the value of the speed Va of the drawing belt 16, or the length of time in which the drawing belt 16 is driven at the speed Va may be changed in accordance with at least one of the grammage, size, and material of the sheet.

As an example, the value of the speed Va for stacking a sheet with a second grammage larger than a first grammage is set larger than the value of the speed Va for stacking a sheet with the first grammage. That is, the stacker control portion 210 sets the value of the speed Va for stacking a sheet with the first grammage, to a smaller value than the value of the speed Va for stacking a sheet with the second grammage larger than the first grammage. With this operation, the amount of conveyance by the drawing belt 16 becomes smaller for a sheet with the first grammage and less weight, and becomes larger for a sheet with the second grammage and more weight. Thus, the alignment can be improved for both of the sheet with the first grammage and the sheet with the second grammage.

In another case, as an example, the timing at which the speed of the drawing belt 16 is decreased from the speed Va to the speed Vb in a case where a sheet with the second grammage larger than the first grammage is stacked is delayed from the timing at which the speed of the drawing belt 16 is decreased from the speed Va to the speed Vb in a case where a sheet with the first grammage is stacked. That is, the stacker control portion 210 sets the timing at which the speed of the drawing belt 16 is decreased from the speed Va to the speed Vb in a case where a sheet with the first grammage is stacked, to an earlier timing than the timing at which the speed of the drawing belt 16 is decreased from the speed Va to the speed Vb in a case where a sheet with the second grammage larger than the first grammage is stacked. With this operation, the amount of conveyance by the drawing belt 16 becomes smaller for a sheet with the first grammage and less weight, and becomes larger for a sheet with the second grammage and more weight. Thus, the alignment can be improved for both of the sheet with the first grammage and the sheet with the second grammage.

In another case, as an example, the value of the speed Va for stacking a sheet with a second size whose area is larger than that of a first size is set larger than the value of the speed Va for stacking a sheet with the first size. That is, the stacker control portion 210 sets the value of the speed Va for stacking a sheet with the first size, to a smaller value than the value of the speed Va for stacking a sheet with the second size whose area is larger than that of the first size. With this operation, the amount of conveyance by the drawing belt 16 becomes smaller for a sheet with the first size and less weight, and becomes larger for a sheet with the second size and more weight. Thus, the alignment can be improved for both of the sheet with the first size and the sheet with the second size.

In another case, as an example, the timing at which the speed of the drawing belt 16 is decreased from the speed Va to the speed Vb in a case where a sheet with the second size whose area is larger than that of the first size is stacked is delayed from the timing at which the speed of the drawing belt 16 is decreased from the speed Va to the speed Vb in a case where a sheet with the first size is stacked. That is, the stacker control portion 210 makes the timing at which the speed of the drawing belt 16 is decreased from the speed Va to the speed Vb in a case where a sheet with the first size is stacked, to an earlier timing than the timing at which the speed of the drawing belt 16 is decreased from the speed Va to the speed Vb in a case where a sheet with the second size whose area is larger than that of the first size is stacked. With this operation, the amount of conveyance by the drawing belt 16 becomes smaller for a sheet with the first size and less weight, and becomes larger for a sheet with the second size and more weight. Thus, the alignment can be improved for both of the sheet with the first size and the sheet with the second size.

In another case, as an example, the value of the speed Va for stacking a sheet with a second material whose density is larger than that of a first material is set larger than the value of the speed Va for stacking a sheet with the first material. That is, the stacker control portion 210 sets the value of the speed Va for stacking a sheet with the first material, to a smaller value than the value of the speed Va for stacking a sheet with the second material whose density is larger than that of the first material. With this operation, the amount of conveyance by the drawing belt 16 becomes smaller for a sheet with the first material and less weight, and becomes larger for a sheet with the second material and more weight. Thus, the alignment can be improved for both of the sheet with the first material and the sheet with the second material. Note that an example of the sheet with the first material is a plain paper sheet, and an example of the sheet with the second material is a coated paper sheet whose density is generally larger than that of the plain paper sheet. In addition, another example of the sheet with the first material is a recycled paper sheet, and another example of the sheet with the second material is a plain paper sheet whose density is generally larger than that of the recycled paper sheet.

In another case, as an example, the timing at which the speed of the drawing belt 16 is decreased from the speed Va to the speed Vb in a case where a sheet with the second material whose density is larger than that of the first material is stacked is delayed from the timing at which the speed of the drawing belt 16 is decreased from the speed Va to the speed Vb in a case where a sheet with the first material is stacked. That is, the stacker control portion 210 makes the timing at which the speed of the drawing belt 16 is decreased from the speed Va to the speed Vb in a case where a sheet with the first material is stacked, to an earlier timing than the timing at which the speed of the drawing belt 16 is decreased from the speed Va to the speed Vb in a case where a sheet with the second material whose density is larger than that of the first material is stacked. With this operation, the amount of conveyance by the drawing belt 16 becomes smaller for a sheet with the first material and less weight, and becomes larger for a sheet with the second material and more weight. Thus, the alignment can be improved for both of the sheet with the first material and the sheet with the second material.

In addition, in the present embodiment, the side-edge regulation member 18 is moved from the retracting position to the regulation position after the speed of the drawing belt 16 is decreased from the speed Va to the speed Vb. If the drawing belt 16 is driven and rotated at the speed Va even after the sheet is aligned in the sheet width direction by the side-edge regulation member 18, the alignment of the sheet may deteriorate in the sheet width direction. In the present embodiment, however, since the sheet is aligned in the sheet width direction by the side-edge regulation member 18 after the speed of the drawing belt 16 is decreased from the speed Va to the speed Vb, the possibility that the alignment of sheets deteriorates can be reduced.

As described above, according to the present embodiment, the alignment of sheets can be further improved by performing both controls of the rotational speed of the drawing belt 16 and of the intrusion amount of the drawing belt 16.

In addition, in the present embodiment, the rotational speed of the drawing belt 16 and the intrusion amount of the drawing belt 16 can both be changed. Therefore, it is possible to stack a variety of sheets, which differ in slipperiness against the feed belt 16 due to differences in weight, surface properties, etc., with good alignment.

Modification 4

In the above-described embodiment, the description has been made, as an example, for the case where the speed of the drawing belt 16 is increased from the speed Vb to the speed Va when the leading edge Pa of the current sheet P abuts against the abutment slope 14*a*. In addition, in the above-described embodiment, the description has been made, as an example, for the case where the speed of the drawing belt 16 is decreased from the speed Va to the speed Vb when the leading edge Pa of the current sheet P abuts against the leading-edge abutment surface 14*b*. However, the timing for changing the speed of the drawing belt 16 is not limited to this.

That is, in at least a part of a period of time after the leading edge Pa of the current sheet P abuts against the leading-edge abutment surface 14*b* and before the drawing belt 16 contacts the next sheet following the current sheet P, the rotational speed of the drawing belt 16 has only to be the speed Vb slower than the speed Va. With this operation, the possibility that the sheet P moves in the sheet width direction due to the wobbling of the drawing belt 16 after the leading edge Pa of the current sheet P abuts against the leading-edge abutment surface 14*b* can be reduced.

As an example, in consideration of the response time of the belt driving motor 310 (FIG. 2), the speed of the drawing belt 16 may be decreased from the speed Va to the speed Vb before the leading edge Pa of the current sheet P abuts against the leading-edge abutment surface 14*b*. In another case, as an example, for more reliably abutting the leading edge Pa of the sheet P against the leading-edge abutment surface 14*b* and correcting the skew of the sheet P, the speed of the drawing belt 16 may be decreased from the speed Va to the speed Vb, at a timing delayed from a theoretical timing at which the leading edge Pa abuts against the leading-edge abutment surface 14*b*.

The drawing belt 16 has only to rotate at the speed Va, in at least apart of a period of time after the current sheet P contacts the drawing belt 16 and before the leading edge Pa of the current sheet P abuts against the leading-edge abutment surface 14*b*. With this operation, the sheet P can be moved toward the leading-edge abutment surface 14*b* by the drawing belt 16 that is rotating at the speed Va. For example, the speed of the drawing belt 16 may be increased from the speed Vb to the speed Va at a timing at which the leading edge Pa of the sheet P reaches the contact position L1 (FIG. 4A) after the leading edge Pa of the sheet P abuts against the abutment slope 14*a*.

Modification 5

In the above-described embodiment, the description has been made for the configuration in which the speed Vb is set at 0 and the drawing belt 16 is stopped after the leading edge Pa of the sheet P abuts against the leading-edge abutment surface 14*b*. However, the present disclosure is not limited to this. For example, the value of a speed Vc (i.e., a second speed) of the drawing belt 16 obtained after the leading edge Pa of the sheet P abuts against the leading-edge abutment surface 14*b* may be set larger than 0 and smaller than the value of the speed Va (i.e., a first speed). That is, as illustrated in FIG. 6E, the drawing belt 16 may be rotated at the low speed Vc after the leading edge Pa of the current sheet P abuts against the leading-edge abutment surface 14*b*. Even in this configuration, since the force applied to the current sheet P in the sheet width direction after the leading edge Pa of the current sheet P abuts against the leading-edge abutment surface 14*b* is reduced, the alignment of sheets can be improved.

In the present modification, since the difference between the speed Va and the speed Vb is made smaller than the difference between the speed Va and the speed Vb of the above-described embodiment, the time for changing the speed of the belt driving motor 310 is shortened. Thus, even in a case where a small-sized motor with lower output is used as the belt driving motor 310, the deterioration in throughput of the sheet stacking operation, which is caused by the time for changing the speed of the belt driving motor 310, can be avoided.

The present disclosure can provide a sheet stacking apparatus and an image forming apparatus that can improve the alignment of sheets.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-075837, filed on May 1, 2023, which is hereby incorporated by reference herein in its entirety.

What is claimed is:

1. A sheet stacking apparatus comprising:

a stacking portion on which a sheet is stacked;

a conveyance member configured to convey the sheet toward the stacking portion;

an abutment portion against which a leading edge of the sheet in a sheet conveyance direction is abutted;

a belt member having elasticity, disposed above the stacking portion so as to overlap the stacking portion when viewed in a direction of gravity, and configured to come in contact with the sheet conveyed onto the stacking portion and move the sheet toward the abutment portion in the sheet conveyance direction;

a nipping portion configured to nip the belt member;

a lifting/lowering unit configured to lift and lower the nipping portion between a first position and a second position, the first position being a position for causing the belt member to contact the sheet already stacked on the stacking portion, the second position being a position above the first position; and a controller configured to control the lifting/lowering unit such that, in a case where the belt member moves a current sheet and then moves a next sheet to be stacked on the stacking portion after the current sheet is stacked, (i) the nipping portion is positioned at the first position after the belt member contacts the current sheet and before the leading edge of the current sheet abuts against the abutment portion, and (ii) the nipping portion is positioned at the second position after the leading edge of the current sheet abuts against the abutment portion and before the belt member contacts the next sheet.

2. The sheet stacking apparatus according to claim 1, further comprising:

a sheet detection portion configured to detect a sheet, wherein the controller is configured to lift the nipping portion from the first position to the second position when the leading edge of the current sheet abuts against the abutment portion, on a basis of a detection result of the sheet detection portion.

3. The sheet stacking apparatus according to claim 1, further comprising:

a second belt member disposed above the stacking portion; and a gripper attached to the second belt member and configured to move in the sheet conveyance direction while holding the leading edge of the sheet conveyed from the conveyance member in the sheet conveyance direction.

4. The sheet stacking apparatus according to claim 3, further comprising:

a sheet detection portion configured to detect a sheet; and an abutment surface configured to be abutted by the leading edge of the sheet to release the leading edge of the sheet from the gripper, wherein the controller is configured to lower the nipping portion from the second position to the first position when the leading edge of the current sheet abuts against the abutment surface, on a basis of a detection result of the sheet detection portion.

5. The sheet stacking apparatus according to claim 1, wherein the controller is configured to set the first position for stacking a sheet with a first grammage, higher than the first position for stacking a sheet with a second grammage larger than the first grammage.

6. The sheet stacking apparatus according to claim 1, wherein the controller is configured to set a timing at which the controller lifts the nipping portion from the first position to the second position in a case where a sheet with a first grammage is stacked, to an earlier timing than a timing at which the controller lifts the nipping portion from the first position to the second position in a case where a sheet with a second grammage larger than the first grammage is stacked.

7. The sheet stacking apparatus according to claim 1, wherein the controller is configured to set the first position for stacking a sheet with a first size, higher than the first position for stacking a sheet with a second size whose area is larger than that of the first size.

8. The sheet stacking apparatus according to claim 1, wherein the controller is configured to set a timing at which the controller lifts the nipping portion from the first position to the second position in a case where a sheet with a first size is stacked, to an earlier timing than a timing at which the controller lifts the nipping portion from the first position to the second position in a case where a sheet with a second size whose area is larger than that of the first size is stacked.

9. The sheet stacking apparatus according to claim 1, wherein the controller is configured to set the first position for stacking a sheet with a first material, higher than the first position for stacking a sheet with a second material whose density is larger than that of the first material.

10. The sheet stacking apparatus according to claim 1, wherein the controller is configured to set a timing at which the controller lifts the nipping portion from the first position to the second position in a case where a sheet with a first material is stacked, to an earlier timing than a timing at which the controller lifts the nipping portion from the first position to the second position in a case where a sheet with a second material whose density is larger than that of the first material is stacked.

11. The sheet stacking apparatus according to claim 1, wherein in a case where the nipping portion is positioned at the second position, the belt member is separated upward from the sheet stacked on the stacking portion.

12. The sheet stacking apparatus according to claim 1, wherein in a case where the nipping portion is positioned at the second position, the belt member is in contact with the sheet stacked on the stacking portion, at a contact pressure lower than a contact pressure at which the belt member is in contact with the sheet stacked on the stacking portion in a case where the nipping portion is positioned at the first position.

13. The sheet stacking apparatus according to claim 1, further comprising:

a regulation member configured to move between a regulation position and a retracting position, the regulation position being a position at which the regulation member regulates a position of a sheet on the stacking portion in a sheet width direction orthogonal to the sheet conveyance direction, the retracting position being a position to which the regulation member is retracted outward from the regulation position in the sheet width direction, wherein the controller is configured to move the regulation member from the retracting position to the regulation position after lifting the nipping portion from the first position to the second position.

14. The sheet stacking apparatus according to claim 1, wherein the nipping portion includes a roller pair having a first roller arranged to contact an inner surface of the belt member and a second roller arranged to contact an outer surface of the belt member, wherein the roller pair is configured to rotate with the belt member nipped between the first roller and the second roller.

15. The sheet stacking apparatus according to claim 1, further comprising:

a driving source configured to drive and rotate the belt member, wherein the controller is configured to control the driving source such that the belt member rotates at a first speed after the belt member contacts the current sheet and before the leading edge of the current sheet abuts against the abutment portion, and that a rotational speed of the belt member is set at a second speed slower than the first speed in at least a part of a period of time after the leading edge of the current sheet abuts against the abutment portion and before the belt member contacts the next sheet.

16. An image forming apparatus comprising:

an image forming apparatus body including an image forming portion configured to form an image on a sheet; and the sheet stacking apparatus according to claim 1, wherein the sheet stacking apparatus is configured to receive a sheet on which an image is formed from the image forming apparatus body and stack the sheet.

17. A sheet stacking apparatus comprising:

a stacking portion on which a sheet is stacked;

a conveyance member configured to convey the sheet toward the stacking portion;

an abutment portion against which a leading edge of the sheet in a sheet conveyance direction is abutted;

a belt member having elasticity, disposed above the stacking portion so as to overlap the stacking portion when viewed in a direction of gravity, and configured to move the sheet conveyed by the conveyance member such that the leading edge of the sheet is abutted against the abutment portion;

a nipping portion configured to nip the belt member;

a lifting/lowering unit configured to lift and lower the nipping portion between a first position and a second position, the first position being a position for causing the belt member to contact the sheet already stacked on the stacking portion, the second position being a position above the first position; and a controller configured to control the lifting/lowering unit such that, in a case where the belt member moves a current sheet and then moves a next sheet to be stacked on the stacking portion after the current sheet is stacked, (i) the belt member conveys the current sheet toward the abutment portion in a state in which the nipping portion is positioned at the first position, and (ii) the nipping portion is moved from the first position to the second position before the belt member contacts the next sheet.

18. The sheet stacking apparatus according to claim 17, further comprising:

a sheet detection portion configured to detect a sheet, wherein the controller is configured to lift the nipping portion from the first position to the second position when the leading edge of the current sheet abuts against the abutment portion, on a basis of a detection result of the sheet detection portion.

19. The sheet stacking apparatus according to claim 17, wherein in a case where the nipping portion is positioned at the second position, the belt member is in contact with the sheet stacked on the stacking portion, at a contact pressure lower than a contact pressure at which the belt member is in contact with the sheet stacked on the stacking portion in a case where the nipping portion is positioned at the first position.

* * * * *